US009732454B2

(12) United States Patent
Davis et al.

(10) Patent No.: US 9,732,454 B2
(45) Date of Patent: Aug. 15, 2017

(54) TEXTURED ELEMENTS INCORPORATING NON-WOVEN TEXTILE MATERIALS AND METHODS FOR MANUFACTURING THE TEXTURED ELEMENTS

(71) Applicant: NIKE, Inc., Beaverton, OR (US)

(72) Inventors: Carrie L. Davis, Portland, OR (US); Bhupesh Dua, Portland, OR (US); James A. Niegowski, Portland, OR (US)

(73) Assignee: NIKE, Inc., Beaverton, OR (US)

( * ) Notice: Subject to any disclaimer, the term of this patent is extended or adjusted under 35 U.S.C. 154(b) by 339 days.

(21) Appl. No.: 14/528,491

(22) Filed: Oct. 30, 2014

(65) Prior Publication Data

US 2015/0123305 A1 May 7, 2015

Related U.S. Application Data

(60) Division of application No. 13/482,182, filed on May 29, 2012, now Pat. No. 8,906,275, which is a (Continued)

(51) Int. Cl.
*D04H 1/44* (2006.01)
*D04H 1/54* (2012.01)
(Continued)

(52) U.S. Cl.
CPC ..... *D04H 1/44* (2013.01); *D04H 1/542* (2013.01); *D04H 1/56* (2013.01); *D04H 1/76* (2013.01);
(Continued)

(58) Field of Classification Search
None
See application file for complete search history.

(56) References Cited

U.S. PATENT DOCUMENTS 236,323 A 1/1881 Graf
610,390 A 9/1898 Felbel
(Continued)

FOREIGN PATENT DOCUMENTS

CN 85106873 A 3/1987
CN 1190931 8/1998
(Continued)

OTHER PUBLICATIONS

Notice of Allowance mailed Apr. 11, 2014 for U.S. Appl. No. 13/045,168.

(Continued)

*Primary Examiner* — Mary F Theisen
(74) *Attorney, Agent, or Firm* — Andrew A. Hufford; Brinks Gilson & Lione

(57) ABSTRACT

A method of manufacturing a textured element may include (a) collecting a plurality of filaments upon a textured surface to form a non-woven textile and (b) separating the non-woven textile from the textured surface. Another method of manufacturing a textured element may include depositing a plurality of thermoplastic polymer filaments upon a first surface of a polymer layer to (a) form a non-woven textile and (b) bond the filaments to the polymer layer. A textured surface may then be separated from a second surface of the polymer layer, the second surface being opposite the first surface, and the second surface having a texture from the textured surface.

16 Claims, 22 Drawing Sheets

Related U.S. Application Data continuation-in-part of application No. 12/367,274, filed on Feb. 6, 2009.

(51) Int. Cl.

| | |
|---|---|
| ***D04H 1/56*** | (2006.01) |
| ***D04H 1/72*** | (2012.01) |
| ***D04H 3/08*** | (2006.01) |
| ***D04H 1/542*** | (2012.01) |
| ***D04H 1/76*** | (2012.01) |
| ***D04H 3/07*** | (2012.01) |
| ***D04H 3/14*** | (2012.01) |
| ***D04H 3/16*** | (2006.01) |

(52) U.S. Cl.

CPC ..... *D04H 3/07* (2013.01); *D04H 3/08* (2013.01); *D04H 3/14* (2013.01); *D04H 3/16* (2013.01)

(56) References Cited

U.S. PATENT DOCUMENTS 1,077,556 A 11/1913 Sierra
2,536,163 A 1/1951 Feild, Jr.
2,763,759 A 9/1956 Sanai
3,249,129 A 5/1966 Renfroe
3,375,156 A 3/1968 Edgar, Jr.
3,415,919 A 12/1968 Kippan
3,617,417 A 11/1971 Olson
3,635,625 A 1/1972 Voss
3,681,826 A 8/1972 Bergwerk
3,689,882 A 9/1972 Rene
3,785,915 A 1/1974 Closson
3,790,439 A 2/1974 Zosel et al.
3,912,567 A 10/1975 Schwartz
4,016,329 A 4/1977 Matsuyama et al.
4,041,203 A 8/1977 Brock et al.
4,059,114 A 11/1977 Richards
4,070,217 A 1/1978 Smith, II et al.
4,100,319 A 7/1978 Schwartz
4,107,364 A 8/1978 Sisson
4,168,606 A 9/1979 Callander
4,205,397 A 6/1980 Bechis
4,228,641 A 10/1980 O'Neil
4,265,954 A 5/1981 Romanek
4,310,373 A 1/1982 Schuhmacher et al.
4,355,489 A 10/1982 Heyer et al.
4,410,385 A 10/1983 Murphy et al.
4,445,951 A 5/1984 Lind et al.
4,486,200 A 12/1984 Heyer et al.
4,497,099 A 2/1985 Scott
4,511,615 A 4/1985 Ohta
4,576,852 A 3/1986 Burgess et al.
4,588,630 A 5/1986 Shimalla
4,615,188 A 10/1986 Hursh et al.
4,621,013 A 11/1986 Holtrop et al.
4,647,492 A 3/1987 Grant et al.
4,695,501 A 9/1987 Robinson
4,741,941 A * 5/1988 Englebert ..... A47L 13/16 15/209.1
4,747,901 A 5/1988 Becker et al.
4,781,296 A 11/1988 Morris et al.
4,938,817 A 7/1990 Langley
4,980,927 A 1/1991 Wawiluk et al.
5,003,902 A 4/1991 Benstock et al.
5,102,724 A 4/1992 Okawahara et al.
5,106,678 A 4/1992 Abu-Isa
5,118,550 A 6/1992 Baravian et al.
5,130,178 A 7/1992 Zerfass et al.
5,132,160 A 7/1992 Bird
5,150,787 A 9/1992 Bird et al.
5,203,939 A 4/1993 Sperling et al.
5,230,701 A 7/1993 Meyer et al.
5,238,733 A 8/1993 Joseph et al.
5,255,833 A 10/1993 McAllister
5,282,900 A 2/1994 McDonell et al.
5,306,275 A 4/1994 Bryan
5,316,838 A 5/1994 Crandall et al.
5,324,277 A 6/1994 Daugan et al.
5,328,758 A 7/1994 Markell et al.
5,380,580 A 1/1995 Rogers et al.
5,415,779 A 5/1995 Markell et al.
5,420,794 A 5/1995 James
5,423,783 A 6/1995 Battles et al.
5,458,962 A 10/1995 Birch
5,470,605 A 11/1995 Lundeen
5,478,628 A 12/1995 Billingsley et al.
5,482,756 A 1/1996 Berger et al.
5,496,507 A 3/1996 Angadjivand et al.
5,501,794 A 3/1996 Van De Graaf et al.
5,507,968 A 4/1996 Palaikis
5,539,042 A 7/1996 Birch
5,573,619 A 11/1996 Benedict et al.
5,586,563 A 12/1996 Newman
5,595,649 A 1/1997 Markell et al.
5,603,747 A 2/1997 Matuda et al.
5,604,271 A 2/1997 Lundeen
5,609,706 A 3/1997 Benedict et al.
5,624,726 A 4/1997 Sanocki et al.
5,629,079 A 5/1997 Battles et al.
5,639,287 A 6/1997 Van De Graaf et al.
5,641,563 A 6/1997 Truong et al.
5,651,853 A 7/1997 Wrigley et al.
5,655,833 A 8/1997 Raczynski
5,682,618 A 11/1997 Johnson et al.
5,695,853 A 12/1997 Billingsley et al.
5,714,229 A 2/1998 Ogden
5,743,273 A 4/1998 Newman
5,744,207 A 4/1998 Bartusiak et al.
5,759,659 A 6/1998 Sanocki et al.
5,783,290 A 7/1998 Isaac et al.
5,803,086 A 9/1998 Scholz et al.
5,858,140 A 1/1999 Berger et al.
5,858,515 A 1/1999 Stokes et al.
5,879,493 A 3/1999 Johnson et al.
5,883,019 A 3/1999 Troung et al.
5,888,157 A 3/1999 Guenther et al.
5,928,070 A 7/1999 Lux
5,939,339 A 8/1999 Delmore et al.
RE36,323 E 10/1999 Thompson et al.
5,981,033 A 11/1999 Haunschild et al.
6,004,642 A 12/1999 Langford
6,013,587 A 1/2000 Truong et al.
6,017,831 A 1/2000 Beardsley et al.
6,069,097 A 5/2000 Suzuki et al.
6,086,911 A 7/2000 Godbey
6,090,234 A 7/2000 Barone et al.
6,110,572 A 8/2000 Groh et al.
6,119,691 A 9/2000 Angadjivand et al.
6,123,752 A 9/2000 Wu et al.
6,174,964 B1 1/2001 Jariwala et al.
6,251,154 B1 6/2001 Van Rossen
6,284,843 B1 9/2001 Jariwala et al.
6,288,157 B1 9/2001 Jariwala et al.
6,315,130 B1 11/2001 Olsen
6,332,465 B1 12/2001 Xue et al.
6,391,200 B2 5/2002 Pulek et al.
6,391,807 B1 5/2002 Jariwala et al.
6,395,211 B1 5/2002 Dettmer et al.
6,406,576 B1 6/2002 Benedict et al.
6,406,577 B1 6/2002 Benedict et al.
6,429,159 B1 8/2002 Watanabe et al.
6,492,183 B1 12/2002 Perman et al.
6,503,855 B1 1/2003 Menzies et al.
6,537,930 B1 3/2003 Middlesworth et al.
6,537,935 B1 3/2003 Seth et al.
6,558,784 B1 5/2003 Norton et al.
6,610,390 B1 8/2003 Kauschke et al.
6,645,611 B2 11/2003 Seth
6,715,188 B1 4/2004 Jackson et al.
6,719,744 B2 4/2004 Kinnear et al.
6,769,202 B1 8/2004 Luthi et al.
6,773,718 B2 8/2004 Seth et al.
6,783,574 B1 8/2004 Angadjivand et al.

(56) References Cited

U.S. PATENT DOCUMENTS 6,784,125 B1 8/2004 Yamakawa et al.
6,784,127 B1 8/2004 Yamakawa et al.
6,835,256 B2 12/2004 Menzies et al.
6,875,710 B2 4/2005 Eaton et al.
6,880,211 B2 4/2005 Jackson et al.
6,910,288 B2 6/2005 Dua
6,942,683 B2 9/2005 Dunshee
6,942,894 B2 9/2005 Alberg et al.
6,967,178 B2 11/2005 Zhou et al.
7,066,182 B1 6/2006 Dunshee
7,147,734 B2 12/2006 Ogle et al.
7,147,904 B1 12/2006 Crawford
7,150,774 B2 12/2006 Kubokawa et al.
7,169,202 B2 1/2007 Kubokawa
7,195,729 B2 3/2007 Jackson et al.
7,230,043 B2 6/2007 Klun et al.
7,238,314 B2 7/2007 Jackson et al.
7,267,681 B2 9/2007 Dunshee
7,291,236 B2 11/2007 Guilhem et al.
7,293,371 B2 11/2007 Aveni
7,303,805 B2 12/2007 Seth et al.
7,311,880 B2 12/2007 Perman et al.
7,320,719 B2 1/2008 Van De Graaf et al.
7,390,451 B2 6/2008 Jackson et al.
7,393,371 B2 7/2008 O'Gary et al.
7,547,650 B2 6/2009 Keep
7,709,075 B2 5/2010 Suzuki
7,955,549 B2 6/2011 Noda et al.
8,850,719 B2 10/2014 Hawkinson et al.
8,906,275 B2 12/2014 Davis et al.
2001/0008683 A1 7/2001 Takai et al.
2001/0035598 A1 11/2001 Ampulski et al.
2002/0070471 A1* 6/2002 Lee ..... A61F 13/15626 264/40.3
2002/0090875 A1 7/2002 Lasko et al.
2002/0132121 A1 9/2002 Palacio et al.
2002/0137418 A1 9/2002 Seth
2002/0150610 A1 10/2002 Kono et al.
2003/0060858 A1 3/2003 Kieval et al.
2003/0091617 A1 5/2003 Mrozinski et al.
2003/0119411 A1 6/2003 Yamakawa et al.
2003/0124310 A1 7/2003 Ellis et al.
2003/0137221 A1 7/2003 Radziemski et al.
2003/0162458 A1 8/2003 Tsujiyama et al.
2003/0171051 A1 9/2003 Bergsten et al.
2004/0050506 A1 3/2004 Haiber et al.
2004/0060858 A1 4/2004 Lucas et al.
2004/0118018 A1 6/2004 Dua
2004/0186482 A1 9/2004 Kolb et al.
2004/0216329 A1 11/2004 Evans
2004/0224596 A1 11/2004 Mathis et al.
2004/0241399 A1 12/2004 Marmon et al.
2005/0084647 A1 4/2005 Menzies et al.
2005/0106326 A1 5/2005 Audenaert et al.
2005/0160629 A1 7/2005 Jungkind
2005/0188907 A1 9/2005 D'Henin
2005/0193592 A1 9/2005 Dua et al.
2005/0217226 A1 10/2005 Sundet et al.
2006/0009106 A1 1/2006 Nishimura et al.
2006/0036230 A1 2/2006 Mills et al.
2006/0081329 A1 4/2006 Kikuchi
2006/0121812 A1 6/2006 Suzuki et al.
2006/0141881 A1 6/2006 Bergsten et al.
2006/0143947 A1 7/2006 Ellis et al.
2006/0165939 A1 7/2006 Hottner
2006/0169387 A1 8/2006 Nayar et al.
2006/0180067 A1 8/2006 Yamazaki et al.
2006/0204558 A1 9/2006 Kantner et al.
2006/0223403 A1 10/2006 Mahboob
2006/0246260 A1 11/2006 Sundet et al.
2006/0276095 A1 12/2006 Dua et al.
2007/0049148 A1 3/2007 Chien et al.
2007/0049153 A1* 3/2007 Dunbar ..... A47L 13/16 442/400
2007/0049646 A1 3/2007 Moore et al.
2007/0129524 A1 6/2007 Sunkara
2007/0135008 A1 6/2007 Hall et al.
2007/0169379 A1 7/2007 Hazenberg et al.
2007/0176325 A1 8/2007 Jackson et al.
2007/0186482 A1 8/2007 Sudo
2007/0199210 A1 8/2007 Vattes et al.
2007/0212963 A1 9/2007 Keep
2007/0298671 A1 12/2007 Noda et al.
2007/0298697 A1 12/2007 Charmoille et al.
2008/0001431 A1 1/2008 Thompson et al.
2008/0022642 A1 1/2008 Fox et al.
2008/0022643 A1 1/2008 Fox et al.
2008/0026659 A1 1/2008 Brandner et al.
2008/0044622 A1 2/2008 Noda et al.
2008/0064279 A1 3/2008 Browning et al.
2008/0070464 A1 3/2008 Alberg et al.
2008/0134543 A1 6/2008 Klein
2008/0139067 A1 6/2008 Mukai et al.
2008/0148946 A1 6/2008 Lotgerink-Bruinenberg
2008/0241476 A1 10/2008 Olguin
2008/0245720 A1 10/2008 Hutchinson et al.
2008/0245725 A1 10/2008 Patel et al.
2008/0246182 A1 10/2008 Patel et al.
2008/0276805 A1 11/2008 Lotgerink-Bruinenberg
2009/0068908 A1 3/2009 Hinchcliff
2009/0140470 A1 6/2009 Dua et al.
2009/0277041 A1 11/2009 Hubner
2010/0035963 A1 2/2010 Chajut et al.
2010/0037483 A1 2/2010 Meschter et al.
2010/0077634 A1 4/2010 Bell
2010/0095554 A1 4/2010 Gillespie
2010/0147444 A1 6/2010 Hsu et al.
2010/0154256 A1 6/2010 Dua et al.
2010/0175276 A1 7/2010 Dojan et al.
2010/0186874 A1 7/2010 Sussmann
2010/0199406 A1 8/2010 Dua et al.
2010/0199520 A1 8/2010 Dua et al.
2010/0251491 A1 10/2010 Dojan et al.
2010/0287790 A1 11/2010 Sokolowski et al.
2010/0325916 A1 12/2010 Dua et al.
2011/0098147 A1 4/2011 Crane
2012/0227282 A1 9/2012 Hawkinson et al.
2012/0291314 A1 11/2012 Sokolowski et al.
2013/0067639 A1 3/2013 Dua et al.
2013/0067768 A1 3/2013 Dua et al.
2013/0068378 A1 3/2013 Dua et al.
2013/0069266 A1 3/2013 Dua et al.
2013/0232815 A1 9/2013 Meythaler et al.
2013/0255103 A1 10/2013 Dua et al.
2013/0260104 A1 10/2013 Dua et al.
2013/0260629 A1 10/2013 Dua et al.
2013/0285294 A1* 10/2013 Huang ..... D04H 13/00 264/500

FOREIGN PATENT DOCUMENTS

CN 1201846 A 12/1998
CN 2354400 Y 12/1999
CN 1451330 A 10/2003
CN 1497086 A 5/2004
CN 1571871 A 1/2005
CN 1802104 A 7/2006
CN 101001546 A 7/2007
CN 101125044 A 2/2008
CN 101326212 12/2008
CN 101500794 A 8/2009
CN 101542032 A 9/2009
CN 1278424 A 1/2011
CN 102137600 A 7/2011
CN 102292487 A 12/2011
DE 2109143 A1 10/1972
DE 19642253 A1 8/1997
DE 29911710 U1 12/1999
DE 102007004146 A1 7/2008
DE 102007035729 A1 2/2009
EP 0264132 A2 4/1988
EP 0304301 A2 2/1989
EP 0327402 A2 8/1989
EP 0370835 A2 5/1990

(56) References Cited

FOREIGN PATENT DOCUMENTS

| | | | |
|---|---|---|---|
| EP | 0559969 | A1 | 9/1993 |
| EP | 1068889 | A1 | 1/2001 |
| EP | 1167606 | A1 | 1/2002 |
| EP | 1264561 | A1 | 12/2002 |
| EP | 1340848 | A1 | 9/2003 |
| EP | 1342825 | A1 | 9/2003 |
| EP | 1418092 | A1 | 5/2004 |
| EP | 1491105 | A1 | 12/2004 |
| EP | 1589140 | A1 | 10/2005 |
| EP | 1884582 | A1 | 2/2008 |
| EP | 2084981 | A1 | 8/2009 |
| EP | 2397594 | A2 | 12/2011 |
| EP | 2407302 | A2 | 1/2012 |
| EP | 2453048 | A1 | 5/2012 |
| EP | 2488685 | A1 | 8/2012 |
| EP | 2393972 | B1 | 1/2013 |
| EP | 2397593 | B1 | 7/2013 |
| EP | 2683866 | A1 | 1/2014 |
| GB | 1353183 | A | 5/1974 |
| GB | 1384326 | A | 2/1975 |
| GB | 1491602 | A | 11/1977 |
| GB | 2115741 | A | 9/1983 |
| JP | S4703280 | | 11/1972 |
| JP | S4732180 | U | 12/1972 |
| JP | S6052237 | B2 | 10/1982 |
| JP | 61-000655 | | 1/1986 |
| JP | S61655 | A | 1/1986 |
| JP | 61-111993 | | 7/1986 |
| JP | S61111993 | U | 7/1986 |
| JP | S62159383 | A | 7/1987 |
| JP | S62194030 | A | 8/1987 |
| JP | 62203211 | | 12/1987 |
| JP | 62203212 | | 12/1987 |
| JP | S62194030 | U | 12/1987 |
| JP | S62203211 | U | 12/1987 |
| JP | S62203212 | U | 12/1987 |
| JP | H0257993 | A | 2/1990 |
| JP | 257993 | | 4/1990 |
| JP | H02130206 | A | 5/1990 |
| JP | H02165942 | | 6/1990 |
| JP | H02165942 | A | 6/1990 |
| JP | H02130206 | | 10/1990 |
| JP | H02286225 | | 11/1990 |
| JP | H02286225 | A | 11/1990 |
| JP | 3200885 | | 9/1991 |
| JP | H03200885 | A | 9/1991 |
| JP | 3224421 | | 10/1991 |
| JP | H03224421 | A | 10/1991 |
| JP | H04108152 | | 4/1992 |
| JP | H04108152 | A | 4/1992 |
| JP | 05-022792 | | 1/1993 |
| JP | H054291 | | 1/1993 |
| JP | H054291 | A | 1/1993 |
| JP | H0522792 | A | 1/1993 |
| JP | H05200890 | | 8/1993 |
| JP | H05200890 | A | 8/1993 |
| JP | 5321119 | | 12/1993 |
| JP | H05321119 | A | 12/1993 |
| JP | 06126754 | | 5/1994 |
| JP | H06126754 | A | 5/1994 |
| JP | H06158501 | | 6/1994 |
| JP | H06158501 | A | 6/1994 |
| JP | H11320736 | | 11/1994 |
| JP | 07-197355 | | 1/1995 |
| JP | 7157957 | | 6/1995 |
| JP | H07157957 | A | 6/1995 |
| JP | 3016014 | | 7/1995 |
| JP | H07197355 | A | 8/1995 |
| JP | 3016014 | U | 9/1995 |
| JP | 07-252762 | | 10/1995 |
| JP | H07252762 | A | 10/1995 |
| JP | H08301 | A | 1/1996 |
| JP | 8104164 | | 4/1996 |
| JP | H08104164 | A | 4/1996 |
| JP | H08503745 | | 4/1996 |
| JP | 8296161 | | 11/1996 |
| JP | H08296161 | A | 11/1996 |
| JP | 8323903 | | 12/1996 |
| JP | H08323903 | A | 12/1996 |
| JP | 09-013252 | | 1/1997 |
| JP | H0913252 | A | 1/1997 |
| JP | 0965907 | | 3/1997 |
| JP | 9058200 | | 3/1997 |
| JP | H0958200 | A | 3/1997 |
| JP | H0965907 | A | 3/1997 |
| JP | 9188951 | | 7/1997 |
| JP | H09188951 | A | 7/1997 |
| JP | 09-267456 | | 10/1997 |
| JP | H09267456 | A | 10/1997 |
| JP | H09275293 | | 10/1997 |
| JP | H09275293 | A | 10/1997 |
| JP | H1077556 | A | 3/1998 |
| JP | H1077566 | A | 3/1998 |
| JP | 10245760 | | 9/1998 |
| JP | H10245760 | A | 9/1998 |
| JP | 10-273868 | | 10/1998 |
| JP | H10273868 | A | 10/1998 |
| JP | H10292271 | | 11/1998 |
| JP | H10292271 | A | 11/1998 |
| JP | H10323661 | | 12/1998 |
| JP | H10323661 | A | 12/1998 |
| JP | H1112912 | | 1/1999 |
| JP | H1112912 | A | 1/1999 |
| JP | 11061616 | | 3/1999 |
| JP | H1161616 | A | 3/1999 |
| JP | 11090836 | | 4/1999 |
| JP | H1190836 | A | 4/1999 |
| JP | H11217799 | | 8/1999 |
| JP | H11217799 | A | 8/1999 |
| JP | 11320800 | | 11/1999 |
| JP | H11320736 | A | 11/1999 |
| JP | H11320800 | A | 11/1999 |
| JP | 2000503610 | A | 3/2000 |
| JP | 2000248454 | A | 9/2000 |
| JP | 2001058002 | A | 3/2001 |
| JP | 1077556 | | 7/2001 |
| JP | 2001179889 | A | 7/2001 |
| JP | 2001181905 | A | 7/2001 |
| JP | 2001523772 | A | 11/2001 |
| JP | 2002234547 | A | 8/2002 |
| JP | 2002317367 | A | 10/2002 |
| JP | U3093555 | | 2/2003 |
| JP | 2003117325 | A | 4/2003 |
| JP | 3093555 | U | 5/2003 |
| JP | 2003517950 | A | 6/2003 |
| JP | 2003227060 | A | 8/2003 |
| JP | 2003524534 | A | 8/2003 |
| JP | 2003310331 | A | 11/2003 |
| JP | 2004150008 | A | 5/2004 |
| JP | 2004192182 | A | 7/2004 |
| JP | 2004211258 | A | 7/2004 |
| JP | 2004244791 | | 9/2004 |
| JP | 2004244791 | A | 9/2004 |
| JP | 2004306149 | | 11/2004 |
| JP | 2004306149 | A | 11/2004 |
| JP | 2005029907 | | 2/2005 |
| JP | 2005029907 | A | 2/2005 |
| JP | 2005187954 | | 7/2005 |
| JP | 2005187954 | A | 7/2005 |
| JP | 2005212055 | | 8/2005 |
| JP | 2005212055 | A | 8/2005 |
| JP | 2006-511306 | | 4/2006 |
| JP | 2006511306 | | 4/2006 |
| JP | 2006511306 | A | 4/2006 |
| JP | 2006-192723 | | 7/2006 |
| JP | 2006192723 | A | 7/2006 |
| JP | 2006193881 | A | 7/2006 |
| JP | 2006223403 | A | 8/2006 |
| JP | 2006274453 | | 10/2006 |
| JP | 2006274453 | A | 10/2006 |
| JP | 2006299425 | A | 11/2006 |
| JP | 2007-516046 | | 6/2007 |
| JP | 2007516046 | A | 6/2007 |
| JP | 2007522908 | | 8/2007 |

(56) References Cited

FOREIGN PATENT DOCUMENTS

| | | | |
|---|---|---|---|
| JP | 2007522908 | A | 8/2007 |
| JP | 2007537372 | | 12/2007 |
| JP | 2007537372 | A | 12/2007 |
| JP | 2008007930 | | 1/2008 |
| JP | 2008007930 | A | 1/2008 |
| JP | 2008-517183 | | 5/2008 |
| JP | 4785700 | B2 | 5/2008 |
| JP | 2008101285 | | 5/2008 |
| JP | 2008101285 | A | 5/2008 |
| JP | 2008513626 | A | 5/2008 |
| JP | 2008517183 | A | 5/2008 |
| JP | 2008138908 | | 6/2008 |
| JP | 2008138908 | A | 6/2008 |
| JP | 2008169506 | A | 7/2008 |
| JP | 2009538197 | | 11/2009 |
| JP | 2009538197 | A | 11/2009 |
| JP | 2010-534535 | | 11/2010 |
| JP | 2010534535 | A | 11/2010 |
| JP | 2011-081082 | | 4/2011 |
| JP | 2012-517535 | | 8/2012 |
| JP | 2012517535 | A | 8/2012 |
| JP | 5226844 | | 3/2013 |
| JP | 5226844 | B2 | 7/2013 |
| JP | 5411906 | B2 | 11/2013 |
| JP | S5411906 | B | 11/2013 |
| JP | 5615786 | | 9/2014 |
| JP | 2015522722 | A | 8/2015 |
| KR | 10-2005-0088367 | | 9/2005 |
| KR | 10-2009-0023339 | | 3/2009 |
| WO | 0145927 | A1 | 6/2001 |
| WO | WO0145927 | | 6/2001 |
| WO | 02054894 | A1 | 7/2002 |
| WO | WO02054894 | | 7/2002 |
| WO | 03007864 | A1 | 1/2003 |
| WO | WO03007864 | | 1/2003 |
| WO | 03021024 | A1 | 3/2003 |
| WO | WO03021024 | | 3/2003 |
| WO | 2004060093 | A1 | 7/2004 |
| WO | WO2004060093 | | 7/2004 |
| WO | 2005000055 | A1 | 1/2005 |
| WO | WO 2005/000055 | A1 | 1/2005 |
| WO | 2005063071 | A2 | 7/2005 |
| WO | WO2005063071 | | 7/2005 |
| WO | 2005082188 | A1 | 9/2005 |
| WO | WO2005082188 | | 9/2005 |
| WO | 2005112677 | A2 | 12/2005 |
| WO | WO2005112677 | | 12/2005 |
| WO | 2007103244 | A2 | 9/2007 |
| WO | WO2007103244 | | 9/2007 |
| WO | 2007139567 | A1 | 12/2007 |
| WO | 2007140054 | A1 | 12/2007 |
| WO | WO2007139567 | | 12/2007 |
| WO | WO2007140054 | | 12/2007 |
| WO | 2008069280 | A1 | 6/2008 |
| WO | WO2008069280 | | 6/2008 |
| WO | 2008077785 | A1 | 7/2008 |
| WO | WO 2008/077785 | A1 | 7/2008 |
| WO | WO 2008/111294 | A1 | 9/2008 |
| WO | 2009027701 | A1 | 3/2009 |
| WO | WO 2009/027701 | A1 | 3/2009 |
| WO | WO 2010/036557 | A1 | 4/2010 |
| WO | 2011046762 | A1 | 4/2011 |
| WO | WO 2011/046762 | A1 | 4/2011 |
| WO | 2013181082 | A1 | 12/2013 |
| WO | WO 2013/181082 | A1 | 12/2013 |

OTHER PUBLICATIONS

Notice of Allowance mailed Feb. 11, 2013 in European Patent Application No. 11174750.7 filed Jul. 20, 2011.
Notice of Allowance mailed Nov. 11, 2013 for Chinese Application No. 201080005095.6 filed Jan. 27, 2010.
Notice of Allowance mailed Feb. 21, 2013 for Japanese Application No. 2011-225851 filed Oct. 13, 2011.
Notice of Allowance mailed May 22, 2013 for European Application No. 11174753.1 filed Jul. 20, 2011.
Notice of Allowance mailed Jul. 24, 2012 for European Application No. 10734588.6 filed Jan. 27, 2010.
Notice of Allowance mailed Aug. 1, 2014 in U.S. Appl. No. 13/482,182.
Notice to Terminate Reconsideration by Examiner before Appeal & Result of Reconsideration by Examiner mailed Oct. 16, 2014 for Japanese Patent Application No. 2011-549186.
Notification of Reason(s) for Refusal dated Aug. 21, 2014 in Japanese Patent Application No. 2013-164367.
Notification of Reason(s) for Refusal mailed May 1, 2014 for Japanese Application No. 2011-225846.
Notification of Reason(s) for Refusal mailed May 22, 2014 for Japanese Application No. 2011-225849.
Notification of Reason(s) for Refusal mailed May 29, 2014 for Japanese Application No. 2012-534219.
Office Action mailed Dec. 1, 2011 for U.S. Appl. No. 12/367,274, filed Feb. 6, 2009.
Office Action mailed Oct. 1, 2014 in U.S. Appl. No. 13/426,290, filed Mar. 21, 2012.
Office Action mailed Jan. 6, 2014 for U.S. Appl. No. 13/045,168.
Office Action mailed Feb. 7, 2013 for Japanese Application No. 2011-225849 filed Oct. 13, 2011.
Office Action mailed Feb. 7, 2013 for Japanese Application No. 2011-549186 filed Aug. 1, 2011.
Office Action mailed May 9, 2013 for Japanese Application No. 2011-225827 filed Oct. 13, 2011 and the English translation thereof.
Office Action mailed Nov. 11, 2013 for European Application No. 10779359.8.
Office Action mailed Jun. 13, 2013 for Japanese Application No. 2011-534219 filed Apr. 11, 2012 and the English translation thereof.
Office Action mailed Feb. 14, 2013 for Japanese Application No. 2011-225838 filed Oct. 13, 2011.
Office Action mailed Jun. 14, 2012 for U.S. Appl. No. 12/579,838, filed Oct. 15, 2009.
Office Action mailed Feb. 21, 2013 for Japanese Application No. 2011-225846 filed Oct. 13, 2011.
Office Action mailed Jan. 22, 2013 for Chinese Application No. 20108005095.6 filed Dec. 12, 2012.
Office Action mailed Jan. 24, 2013 for European Application No. 11174751.5 filed Jan. 27, 2010.
Office Action mailed Mar. 26, 2015 for U.S. Appl. No. 13/426,361, filed Mar. 21, 2012.
Office Action mailed Sep. 30, 2014 in U.S. Appl. No. 12/579,838, filed Oct. 15, 2009.
Partial European Search Report for European Application No. EP11175063, mailed on Nov. 4, 2011, 5 pages.
Partial European Search Report mailed Nov. 4, 2011 for European Application No. 11174751.5 filed Jan. 27, 2010.
Partial European Search Report mailed Nov. 28, 2011 for European Application No. 11177097.0 filed Aug. 10, 2011.
Partial Search Report for European Application No. 11174750.7, mailed on Nov. 4, 2011.
Partial Search Report for European Application No. 11175063.4, mailed on Nov. 4, 2011.
Response for Result of Reconsideration for Japanese Patent Application No. 2011-549186, filed on Dec. 19, 2014.
Response to European Office Action for European Application No. 11174751.5 filed May 16, 2014.
Response to European Search Report and Written Opinion filed Sep. 21, 2012 for European Application No. 11174751.5 filed Jan. 27, 2010.
Response to European Search Report filed Jan. 11, 2013 for European Application No. 11174747.3 filed Jan. 27, 2010.
Response to European Search Report filed Aug. 13, 2012 for European Application No. 11175063.4 filed Jan. 27, 2010.
Response to European Search Report filed Aug. 16, 2012 for European Application No. 11174750.7 filed Jan. 27, 2010.
Response to European Search Report filed Dec. 21, 2011 for European Application No. 11174747.3 filed Jan. 27, 2010.
Response to European Search Report mailed on Dec. 23, 2011 in European Patent Application No. 11174747.3.

(56) References Cited

OTHER PUBLICATIONS

Response to Final Office Action filed Mar. 13, 2013 for U.S. Appl. No. 12/579,838, filed Oct. 15, 2009.
Response to Final Office Action filed Sep. 14, 2012 for U.S. Appl. No. 12/579,838, filed Oct. 15, 2009.
Response to Final Office Action filed Jul. 25, 2012 for U.S. Appl. No. 12/367,274, filed Feb. 6, 2009.
Response to Final Office Action mailed Nov. 28, 2012 for U.S. Appl. No. 12/579,838, filed Oct. 15, 2009.
Response to Office Action filed Mar. 1, 2012 for U.S. Appl. No. 12/367,274, filed Feb. 6, 2009.
Response to Office Action filed Aug. 5, 2013 for Japanese Application No. 2011-549186 and the English translation thereof.
Response to Office Action filed Aug. 6, 2013 for Chinese Application No. 201080005095.6 and the English translation thereof.
Response to Office Action filed Aug. 6, 2013 for Japanese Application No. 2011225849 filed Oct. 13, 2011 and the English translation thereof.
Response to Office Action filed Jun. 7, 2013 for Japanese Application No. 2011225838 and the English translation thereof.
Response to Office Action filed Jul. 10, 2013 for Japanese Application No. 2011225846 filed Oct. 13, 2011 and the English translation thereof.
Response to Office Action filed Jun. 10, 2013 for Japanese Application No. 2011225838 filed Oct. 13, 2011 and the English translation thereof.
Response to Office Action filed Sep. 10, 2013 for Japanese Application No. 2011534219 and the English translation thereof.
Response to Office Action filed Aug. 29, 2013 for Japanese Application No. 2011225827 and the English translation thereof.
Response to Office Action mailed Jun. 14, 2012 for U.S. Appl. No. 12/579,838, filed Sep. 14, 2012.
Response to Office Action mailed Jan. 24, 2013 for European Application No. 11174751.5 as filed Aug. 2, 2013.
Response to Search Report and Written Opinion for European Application No. 11174751.5, filed on Sep. 21, 2012.
Voluntary Amendment filed Jan. 10, 2013 for Chinese Application No. 201080046286.7 filed Apr. 13, 2012.
Voluntary Amendment filed Apr. 12, 2012 for Japanese Application No. 20108005095.6 filed Jul. 21, 2011.
Voluntary Amendment filed May 15, 2012 for Japanese Application No. 2012534219 filed Apr. 11, 2012.
Voluntary Amendment filed Oct. 25, 2011 for Japanese Application No. 2011549186 filed Aug. 1, 2011.
Non-Final Office Action mailed Sep. 4, 2015 in U.S. Appl. No. 13/426,290.
Non-Final Office Action mailed Sep. 2, 2015 in U.S. Appl. No. 12/367,274.
Non-Final Office Action mailed Oct. 30, 2015 in U.S. Appl. No. 12/579,838.
Final Office Action mailed Oct. 27, 2015 in U.S. Appl. No. 13/426,361.
Advisory Action mailed Aug. 1, 2012 in U.S. Appl. No. 12/367,274, filed Feb. 6, 2009.
Chinese Office Action dated Jan. 10, 2014 and corresponding Search Report dated Nov. 26, 2013 in Chinese Application No. 201080046286.7.
Decision of Refusal dated Jan. 30, 2014 in Japanese Patent Application No. 2011-225838.
Decision to Grant a Patent dated Aug. 14, 2014 in Japanese Patent Application No. 2011-225838.
European Office Action dated Jan. 22, 2014 in European Patent Application No. 11174751.5.
European Search Report and Written Opinion mailed on Mar. 6, 2012 in European Patent Application No. 11174751.5.
European Search Report mailed on Apr. 17, 2012 in European Patent Application No. 11174753.1.
European Search Report mailed on Jan. 30, 2012 in European Patent Application No. 11174750.7.
European Search Report mailed on Jan. 30, 2012 in European Patent Application No. 11175063.4.
European Search Report mailed on Jun. 11, 2012 in European Patent Application No. 11174747.3.
European Search Report mailed on Nov. 25, 2011 in European Patent Application No. 11174747.3.
Final Office Action mailed on May 9, 2012 in connection with U.S. Appl. No. 12/367,274, filed Feb. 6, 2009.
Final Office Action mailed on Nov. 28, 2012 in U.S. Appl. No. 12/579,838, filed Oct. 15, 2009.
First Office Action (English translation) for related CN Application No. 2013800280311, dated Jan. 27, 2016 (4 pages).
International Preliminary Report and Written Opinion mailed Apr. 26, 2012 in PCT Application No. PCT/US2010/051149.
International Preliminary Report mailed Aug. 18, 2011 in PCT Application No. PCT/US2010/022216.
International Preliminary Report mailed Sep. 19, 2013 in connection with PCT Application No. PCT/US2012/027974.
International Search Report and Written Opinion in PCT Application No. PCT/US2010/051149, mailed on Mar. 18, 2011.
International Search Report and Written Opinion in PCT Application No. PCT/US2010/022216, mailed on Dec. 6, 2010.
International Search Report and Written Opinion mailed Jul. 4, 2012 in PCT Application No. PCT/US2012/027974.
International Search Report and Written Opinion Mailed on Jan. 14, 2011 in connection with PCT Application No. PCT/US2010/034779.
International Search Report and Written Opinion mailed Sep. 30, 2013 in connection with PCT Application No. PCT/US2013/042581.
Non-Final Office Action mailed Aug. 27, 2014 in U.S. Appl. No. 13/426,323.
Non-Final Office Action mailed Aug. 4, 2014 in U.S. Appl. No. 13/426,349.
Notice of Allowance mailed Apr. 11, 2014 in U.S. Appl. No. 13/045,168.
Notice of Allowance mailed Feb. 1, 2013 in European Patent Application No. 11174753.1 filed Jul. 20, 2011.
Notice of Allowance mailed Feb. 1, 2013 in European Patent Application No. 11175063.4 filed Jul. 22, 2011.
Notice of Allowance mailed Feb. 21, 2013 in connection with Japanese Patent Application No. 2011-225851, filed Oct. 13, 2011.
Notice of Allowance mailed Feb. 21, 2013 in European Patent Application No. 2011225851 filed Oct. 13, 2011.
Notice of Allowance mailed Jul. 24, 2012 in European Patent Application No. 10734588.6 filed Jun. 27, 2011.
Notice of Allowance mailed May 22, 2013 in connection with European Patent Application No. 11174753.1, filed Jul. 20, 2011.
Notice of Allowance mailed Nov. 11, 2013 in connection with Chinese Patent Application No. 201080005095.6 and the English translation thereof.
Notice of Allowance mailed Oct. 10, 2013 in connection with Japanese Patent Application No. 2011-225827, filed Oct. 13, 2011 and the English translation thereof.
Notification of Reason(s) for Refusal dated May 1, 2014 in Japanese Patent Application No. 2011-225846.
Notification of Reason(s) for Refusal dated May 22, 2014 in Japanese Patent Application No. 2011-225849.
Notification of Reason(s) for Refusal dated May 29, 2014 in Japanese Patent Application No. 2012-534219.
Office Action mailed Dec. 1, 2011 in connection with U.S. Appl. No. 12/367,274, filed Feb. 6, 2009.
Office Action mailed Feb. 14, 2013 in Japanese Patent Application No. 2011-225838, filed Oct. 13, 2011.
Office Action mailed Feb. 21, 2013 in Japanese Patent Application No. 2011-225846, filed Oct. 13, 2011.
Office Action mailed Feb. 7, 2013 in Japanese Patent Application No. 2011-549186, filed Aug. 1, 2011.
Office Action mailed Feb. 7, 2013 in Japanese Patent Application No. 2011-225849, filed Oct. 13, 2011.
Office Action mailed Jan. 24, 2013 in European Patent Application No. 11174751.5 filed Jul. 20, 2011.

(56) References Cited

OTHER PUBLICATIONS

Office Action mailed Jun. 13, 2013 in connection with Japanese Patent Application No. 2011-534219, filed Apr. 11, 2012 and the English translation thereof.
Office Action mailed May 9, 2013 in connection with Japanese Patent Application No. 2011-225827, filed Oct. 13, 2011 and the English translation thereof.
Office Action mailed Nov. 11, 2013 for European Patent Application No. 10779359.8.
Office Action mailed on Jan. 22, 2013 in Chinese Application No. 20108005095.6, filed Dec. 12, 2012.
Office Action mailed on Jun. 14, 2012 in U.S. Appl. No. 12/579,838, filed Oct. 15, 2009.
Partial European Search Report mailed on Nov. 4, 2011 in connection with European Patent Application No. 11175063.4.
Partial European Search Report mailed on Nov. 4, 2011 in European Patent Application No. 11174751.5.
Partial European Search Report mailed on Nov. 4, 2011 in European Patent Application No. 11174750.7.
Response to European Office Action filed May 16, 2014 in European Patent Application No. 11174751.5.
Response to European Search Report and Written Opinion filed Sep. 21, 2012 in European Patent Application No. 11174751.5.
Response to European Search Report filed Aug. 13, 2012 in European Patent Application No. 11175063.4.
Response to European Search Report filed Aug. 16, 2012 in European Patent Application No. 11174750.7.
Response to European Search Report filed Dec. 23, 2011 in European Patent Application No. 11174747.3.
Response to European Search Report mailed on Jan. 11, 2013 in European Patent Application No. 11174747.3.
Response to Final Office Action filed Jul. 25, 2012 in connection with U.S. Appl. No. 12/367,274, filed Feb. 6, 2009.
Response to Final Office Action filed Mar. 13, 2013 in U.S. Appl. No. 12/579,838, filed Oct. 15, 2009.
Response to Office Action filed Aug. 2, 2013 in connection with European Patent Application No. 11174751.5.
Response to Office Action filed Aug. 29, 2013 in connection with Japanese Patent Application No. 2011-225827, filed Oct. 13, 2011 and the English translation thereof.
Response to Office Action filed Aug. 6, 2013 in connection with Chinese Patent Application No. 201080005095.6 filed Jul. 21, 2011 and the English translation thereof.
Response to Office Action filed Aug. 6, 2013 in connection with Japanese Patent Application No. 2011-225849, filed Oct. 13, 2011 and the English translation thereof.
Response to Office Action filed Aug. 7, 2013 in connection with Japanese Patent Application No. 2011-549186, filed Aug. 1, 2011 and the English translation thereof.
Response to Office Action filed Jul. 10, 2013 in connection with Japanese Patent Application No. 2011-225846, filed Oct. 13, 2011 and the English translation thereof.
Response to Office Action filed Jun. 10, 2013 in connection with Japanese Patent Application No. 2011-225838, filed Oct. 13, 2011 and the English translation thereof.
Response to Office Action filed Mar. 1, 2012 in connection with U.S. Appl. No. 12/367,274, filed Feb. 6, 2009.
Response to Office Action filed Sep. 10, 2013 in connection with Japanese Patent Application No. 2011-534219, filed Apr. 11, 2012 and the English translation thereof.
Response to Office Action filed Sep. 14, 2012 in U.S. Appl. No. 12/579,838, filed Oct. 15, 2009.
Voluntary Amendment filed Apr. 12, 2012 in connection with Chinese Patent Application No. 20108005095.6, filed Jul. 21, 2011.
Voluntary Amendment filed Apr. 12, 2012 in Japanese Patent Application No. 20108005095.6 filed Jul. 21, 2011.
Voluntary Amendment filed Jan. 10, 2013 filed connection with Chinese Patent Application No. 201080046286.7, filed Apr. 13, 2012.
Voluntary Amendment filed Jan. 10, 2013 in Chinese Patent Application No. 2010-80046286.7 filed Apr. 13, 2012.
Voluntary Amendment filed May 15, 2012 in Japanese Patent Application No. 2012-534219 filed Apr. 11, 2012.
Voluntary Amendment filed Oct. 25, 2011 in Japanese Patent Application No. 2011-549186 filed Aug. 1, 2011.
Chawla, Krishan Kumar, "Fibrous Materials," Cambridge University Press, p. 42 (1998).
Chinese Office Action dated Apr. 28, 2015 in Chinese Patent Application No. 201410041109.X.
Chinese Office Action dated May 25, 2015, in Chinese Application No. 201080046286.7.
Chinese Office Action dated May 6, 2015 in Chinese Patent Application No. 201280012038.X.
Chinese Office Action dated Nov. 15, 2014, in Chinese Application No. 201080046286.7.
Decision of Refusal dated Jan. 29, 2015, in Japanese Patent Application No. 2011-225846.
Decision of Refusal dated Mar. 26, 2015, in Japanese Patent Application No. 2011-225849.
European Office Action dated Mar. 31, 2015 in European Patent Application No. 12718759.9.
European Office Action dated Nov. 28, 2014, in European Patent Application No. 11174751.5.
Examination Report dated Oct. 31, 2014 in European Patent Application No. 11174747.3.
Extended European Search Report dated Jul. 17, 2014 in European Patent Application No. 14166582.8.
Final Office Action dated May 21, 2015, in Japanese Patent Application No. 2013-164367.
Final Office Action mailed Dec. 4, 2014 in U.S. Appl. No. 12/367,274.
Final Office Action mailed Dec. 24, 2014 in U.S. Appl. No. 13/426,349.
Final Office Action mailed Feb. 23, 2015 in U.S. Appl. No. 13/426,290.
Final Office Action mailed Feb. 23, 2015 in U.S. Appl. No. 12/579,838.
Final Office Action mailed May 19, 2015, in U.S. Appl. No. 13/426,323.
Humphries, Mary. Fabric Reference. Prentice Hall, Upper Saddle River, NJ. 1996. pp. 84-85.
International Preliminary Report on Patentability mailed Dec. 11, 2014, for PCT Application No. PCT/US2013/042581.
International Search Report and Written Opinion for Application No. PCT/US2013/034916, dated Sep. 19, 2013.
Lord, Peter R., "Handbook of Yarn Technology," in Science, Technology and Economics, Boca Raton, Florida, Woodhead Publishing, pp. 56-61 (2003).
Non-Final Office Action mailed May 12, 2015 in U.S. Appl. No. 13/426,349.
Non-Final Office Action mailed Jul. 21, 2014 in U.S. Appl. No. 12/367,274.
Notice of Allowance mailed Sep. 15, 2015, for European Patent Application No. 13723278.1.
Notice of Allowance mailed Sep. 23, 2015, in U.S. Appl. No. 13/426,349.
Office Action mailed Aug. 17, 2015, in U.S. Appl. No. 13/438,520.
Office Action mailed Aug. 27, 2015 for Chinese Patent Application No. 201380029215.X) and the English translation thereof.
Office Action mailed Mar. 26, 2015 in U.S. Appl. No. 13/426,361.
Office Action mailed Oct. 1, 2014 in U.S. Appl. No. 13/426,290.
Office Action mailed Sep. 30, 2014 in U.S. Appl. No. 12/579,838.
Office Action mailed Sep. 24, 2015, in U.S. Appl. No. 13/426,323.
Office Action, mailed Mar. 16, 2016, with English translation, for Korean Application No. 10-2014-7031180, (11 pages).
Partial European Search Report mailed Nov. 28, 2011 in European Patent Application No. 11177097.0.
Advisory Action mailed Aug. 1, 2012 for U.S. Appl. No. 12/367,274, filed Feb. 6, 2009.
Chinese Office Action mailed Jan. 10, 2014 and corresponding Search Report mailed Nov. 26, 2013 for Chinese Application No. 201080046286.7.

(56) References Cited

OTHER PUBLICATIONS

Chinese Office Action mailed Nov. 15, 2014 in Chinese Application No. 201080046286.7.
Decision of Refusal mailed Jan. 26, 2015 for Japanese Application No. 2011-225846.
Decision of Refusal mailed Mar. 26, 2015 for Japanese Application No. 2011-225849.
Decision of Refusal mailed Jan. 30, 2014 for Japanese Application No. 2011-225838.
European Office Action mailed Jan. 22, 2014 for European Application No. 11174751.5.
European Office Action mailed Nov. 28, 2014 in European Application No. 11174751.5 filed Jan. 27, 2010.
European Search Report and Written Opinion mailed Jun. 11, 2012 for European Application No. 11174747.3 filed Jan. 27, 2010.
European Search Report and Written Opinion mailed Mar. 6, 2012 for European Application No. 11174751.5 filed Jan. 27, 2010.
European Search Report mailed Mar. 6, 2012 for European Application No. 11174751.5 filed Jan. 27, 2010.
European Search Report mailed Jun. 11, 2012 for European Application No. 11174747.3 filed Jan. 27, 2010.
European Search Report mailed Apr. 17, 2012 for European Application No. 11174753.1 filed Jan. 27, 2010.
European Search Report mailed Nov. 25, 2011 for European Application No. 11174747.3 filed Jan. 27, 2010.
European Search Report mailed Jan. 30, 2012 for European Application No. 11174750.7 filed Jan. 27, 2010.
European Search Report mailed Jan. 30, 2012 for European Application No. 11175063.4 filed Jan. 27, 2010.
Examination Report dated Oct. 31, 2014 in European Patent Application No. 11174747.3 filed Jan. 27, 2010.
Extended European Search Report for European Application No. 11175063.4, mailed on Jan. 30, 2012.
Final Office Action mailed Dec. 4, 2014 for U.S. Appl. No. 12/367,274, filed Feb. 6, 2009.
Final Office Action mailed May 9, 2012 for U.S. Appl. No. 12/367,274, filed Feb. 6, 2009.
Final Office Action mailed Feb. 23, 2015 for U.S. Appl. No. 12/579,838, filed Oct. 15, 2009.
Final Office Action mailed Feb. 23, 2015 for U.S. Appl. No. 13/426,290, filed Mar. 21, 2012.
Final Office Action mailed Dec. 24, 2014 for U.S. Appl. No. 13/426,349, filed Mar. 21, 2012.
Final Office Action mailed Nov. 28, 2012 for U.S. Appl. No. 12/579,838, filed Oct. 15, 2009.
International Preliminary Report and Written Opinion for Application No. PCT/US2010/051149, mailed Apr. 26, 2012.
International Preliminary Report for Application No. PCT/US2010/022216, mailed Aug. 18, 2011.
International Preliminary Report for Application No. PCT/US2012/027974, mailed on Sep. 19, 2013.
International Preliminary Report on Patentability for PCT Application No. PCT/US2013/042581, mailed on Dec. 11, 2014.
International Preliminary Report on Patentability for PCT Application No. PCT/US2013/034901, mailed Oct. 16, 2014.
International Preliminary Report on Patentability for PCT Application No. PCT/US2013/034916, mailed Oct. 16, 2014.
International Preliminary Report on Patentability for PCT Application No. PCT/US2013/034931, mailed Oct. 16, 2014.
International Search Report and the Written Opinion for Application No. PCT/US2013/034901, mailed on Dec. 2, 2013.
International Search Report and Written Opinion for Application No. PCT/US2010/022216, mailed Dec. 6, 2010.
International Search Report and Written Opinion for Application No. PCT/US2010/034779, mailed Jan. 14, 2011.
International Search Report and Written Opinion for Application No. PCT/US2010/051149, mailed Mar. 18, 2011.
International Search Report and Written Opinion for Application No. PCT/US2012/027974, mailed Jul. 4, 2012.
International Search Report and Written Opinion for Application No. PCT/US2013/042581, mailed on Sep. 30, 2013.
International Search Report and Written Opinion for PCT Application No. PCT/US2013/034916, mailed Oct. 14, 2013.
Notice of Allowance mailed Feb. 1, 2013 for European Application No. 11174753.1 filed Jan. 27, 2010.
Notice of Allowance mailed Feb. 1, 2013 for European Application No. 11175063.4 filed Jan. 27, 2010.
Notice of Allowance mailed Feb. 1, 2013 for European Application No. 11174750.7 filed Jan. 27, 2010.
Notice of Allowance mailed Oct. 10, 2013 for Japanese Application No. 2011-225827 filed Oct. 13, 2011.
European Office Action dated Aug. 31, 2015 in European Patent Application No. 11174751.5.
European Notice of Allowance dated Sep. 3, 2015 in European Patent Application No. 12718759.9.
Japanese Notice of Allowance dated Aug. 25, 2015 in Japanese Patent Application No. 2011-225849.
Chinese Office Action dated Jul. 24, 2015 in Chinese Patent Application No. 201380028031.1.
Japanese Office Action dated Jul. 9, 2015 in Japanese Patent Application No. 2011-549186.
Third Chinese Office Action (English translation of relevant portions only) for Chinese Patent Application No. 2013800292200, dated approximately Jan. 3, 2017 (10 pages).
Districo—Bonding Yarns—Grilon® Fusible bonding yarns (Jul. 16, 2016); <http://districo.com/page_gb/bondingyarn.htm>.
Non-Final Office Action in U.S. Appl. No. 12/367,274, mailed Nov. 29, 2016 (18 pages).

* cited by examiner

TEXTURED ELEMENTS INCORPORATING NON-WOVEN TEXTILE MATERIALS AND METHODS FOR MANUFACTURING THE TEXTURED ELEMENTS

CROSS-REFERENCE TO RELATED APPLICATION(S)

This non-provisional U.S. patent application is a divisional of and claims priority under 35 U.S.C. 121 to U.S. patent application Ser. No. 13/482,182 which was filed on May 29, 2012 and entitled "Textured Elements Incorporating Non-Woven Textile Materials And Methods For Manufacturing The Textured Elements," such prior U.S. patent application being entirely incorporated herein by reference. This U.S. patent application is a continuation-in-part of and claims priority under 35 U.S.C. 120 to U.S. patent application Ser. No. 12/367,274 which was filed on Feb. 6, 2009 and entitled "Thermoplastic Non-Woven Textile Elements," such prior U.S. patent application being entirely incorporated herein by reference.

BACKGROUND

A variety of products are at least partially formed from textiles. As examples, articles of apparel (e.g., shirts, pants, socks, jackets, undergarments, footwear), containers (e.g., backpacks, bags), and upholstery for furniture (e.g., chairs, couches, car seats) are often formed from various textile elements that are joined through stitching or adhesive bonding. Textiles may also be utilized in bed coverings (e.g., sheets, blankets), table coverings, towels, flags, tents, sails, and parachutes. Textiles utilized for industrial purposes are commonly referred to as technical textiles and may include structures for automotive and aerospace applications, filter materials, medical textiles (e.g. bandages, swabs, implants), geotextiles for reinforcing embankments, agrotextiles for crop protection, and industrial apparel that protects or insulates against heat and radiation. Accordingly, textiles may be incorporated into a variety of products for both personal and industrial purposes.

Textiles may be defined as any manufacture from fibers, filaments, or yarns having a generally two-dimensional structure (i.e., a length and a width that are substantially greater than a thickness). In general, textiles may be classified as mechanically-manipulated textiles or non-woven textiles. Mechanically-manipulated textiles are often formed by weaving or interlooping (e.g., knitting) a yarn or a plurality of yarns, usually through a mechanical process involving looms or knitting machines. Non-woven textiles are webs or mats of filaments that are bonded, fused, interlocked, or otherwise joined. As an example, a non-woven textile may be formed by randomly depositing a plurality of polymer filaments upon a surface, such as a moving conveyor. Various embossing or calendaring processes may also be utilized to ensure that the non-woven textile has a substantially constant thickness, impart texture to one or both surfaces of the non-woven textile, or further bond or fuse filaments within the non-woven textile to each other. Whereas spunbonded non-woven textiles are formed from filaments having a cross-sectional thickness of 10 to 100 microns, meltblown non-woven textiles are formed from filaments having a cross-sectional thickness of less than 10 microns.

SUMMARY

A method of manufacturing a textured element may include (a) collecting a plurality of filaments upon a textured surface to form a non-woven textile and (b) separating the non-woven textile from the textured surface. Another method of manufacturing a textured element may include (a) depositing a plurality of filaments upon a moving and endless loop of textured release paper to form a non-woven textile and (b) separating the non-woven textile from the textured release paper. A further method of manufacturing a textured element may include (a) extruding a plurality of substantially separate filaments that include a thermoplastic polymer material and (b) depositing the filaments upon a moving surface to form a non-woven textile and imprint a texture of the moving surface into the non-woven textile.

The advantages and features of novelty characterizing aspects of the invention are pointed out with particularity in the appended claims. To gain an improved understanding of the advantages and features of novelty, however, reference may be made to the following descriptive matter and accompanying figures that describe and illustrate various configurations and concepts related to the invention.

FIGURE DESCRIPTIONS

The foregoing Summary and the following Detailed Description will be better understood when read in conjunction with the accompanying figures.

DETAILED DESCRIPTION

The following discussion and accompanying figures disclose various configurations of textured elements that incorporate a non-woven textile, as well as methods for manufacturing the textured elements. Although the textured elements are disclosed below as being incorporated into various articles of apparel (e.g., shirts, pants, footwear) for purposes of example, the textured elements may also be incorporated into a variety of other products. For example, the textured elements may be utilized in other types of apparel, containers, and upholstery for furniture. The textured elements may also be utilized in bed coverings, table coverings, towels, flags, tents, sails, and parachutes. Various configurations of the textured elements may also be utilized for industrial purposes, as in automotive and aerospace applications, filter materials, medical textiles, geotextiles, agrotextiles, and industrial apparel. Accordingly, the textured elements may be utilized in a variety of products for both personal and industrial purposes.

Textured Element Configuration

Figure 1:
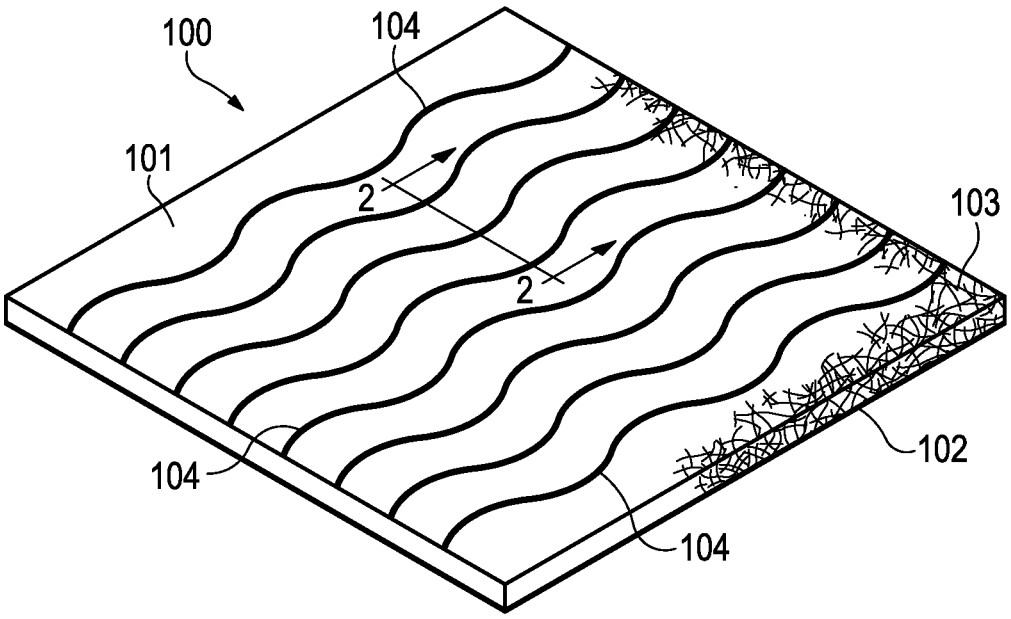
FIG. 1 is a perspective view of a textured non-woven textile.

A textured element 100 with the configuration of a non-woven textile is depicted in FIG. 1 as having a first surface 101 and an opposite second surface 102. Textured element 100 is primarily formed from a plurality of filaments 103 that include a thermoplastic polymer material. Filaments 103 are distributed randomly throughout textured element 100 and are bonded, fused, interlocked, or otherwise joined to form a non-woven textile structure with a relatively constant thickness (i.e., distance between surfaces 101 and 102). An individual filament 103 may be located on first surface 101, on second surface 102, between surfaces 101 and 102, or on both of surfaces 101 and 102. Depending upon the manner in which textured element 100 is formed, multiple portions of an individual filament 103 may be located on first surface 101, different portions of the individual filament 103 may be located on second surface 102, and other portions of the individual filament 103 may be located between surfaces 101 and 102. In order to impart an interlocking structure to the non-woven textile within textured element 100, the various filaments 103 may wrap around each other, extend over and under each other, and pass through various areas of textured element 100. In areas where two or more filaments 103 contact each other, the thermoplastic polymer material forming filaments 103 may be bonded or fused to join filaments 103 to each other. Accordingly, filaments 103 are effectively joined to each other in a variety of ways to form a non-woven textile with a cohesive structure within textured element 100.

Figure 2:
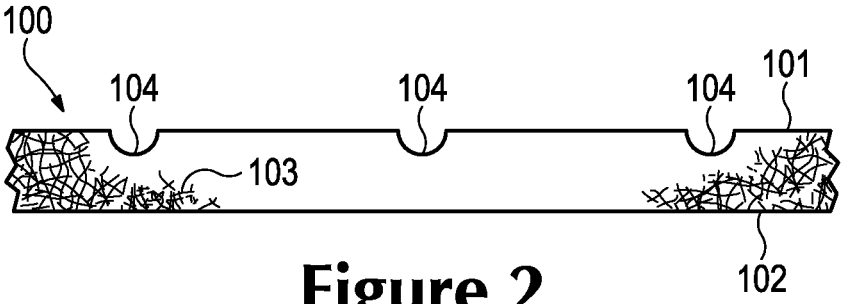
FIG. 2 is a cross-sectional view of the textured non-woven textile, as defined by section line 2 in FIG. 1.

Although textured element 100 has a relatively constant thickness, areas of first surface 101 include a texture 104. In this example, texture 104 has a configuration of a plurality of curved, wave-like, or undulating lines. Referring to FIG. 2, texture 104 forms various indentations, depressions, or other discontinuities in first surface 101 with a hemispherical, curved, or generally rounded shape. In effect, these discontinuities make texture 101 perceptible through either vision, tactile touch, or both. That is, a person may see and/or feel texture 104 in areas of textured element 100. In addition to enhancing the aesthetics of textured element 100, texture 104 may enhance the physical properties of textured element 100, such as strength, abrasion resistance, and permeability to water.

Figure 3A:
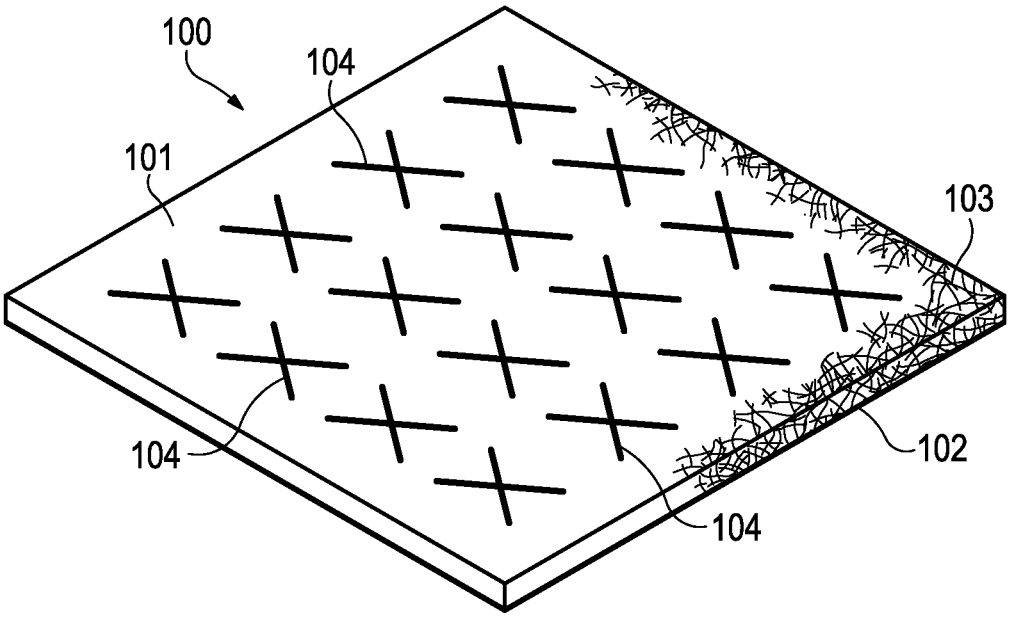
FIGS. 3A-3F are perspective views corresponding with FIG. 1 and depicting additional configurations of the textured non-woven textile.
Figure 3B:
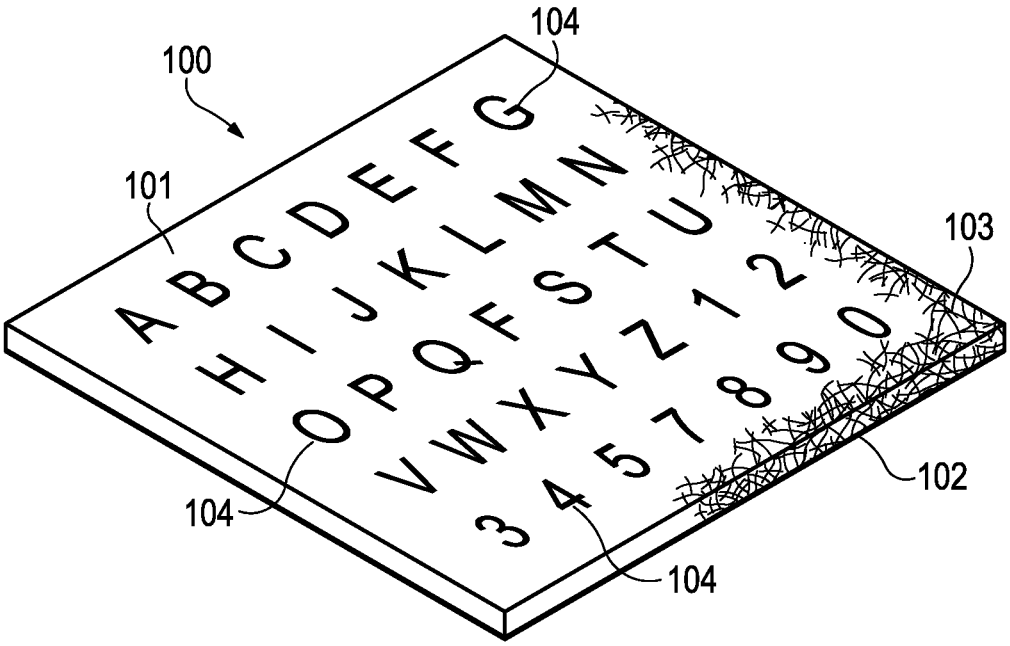
Figure 3C:
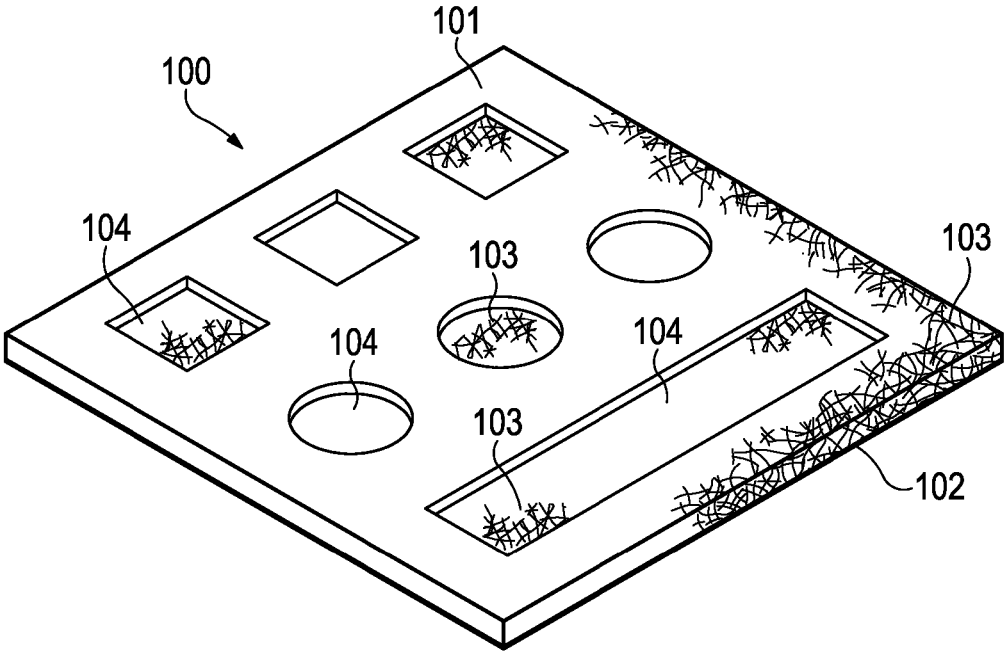
Figure 3D:
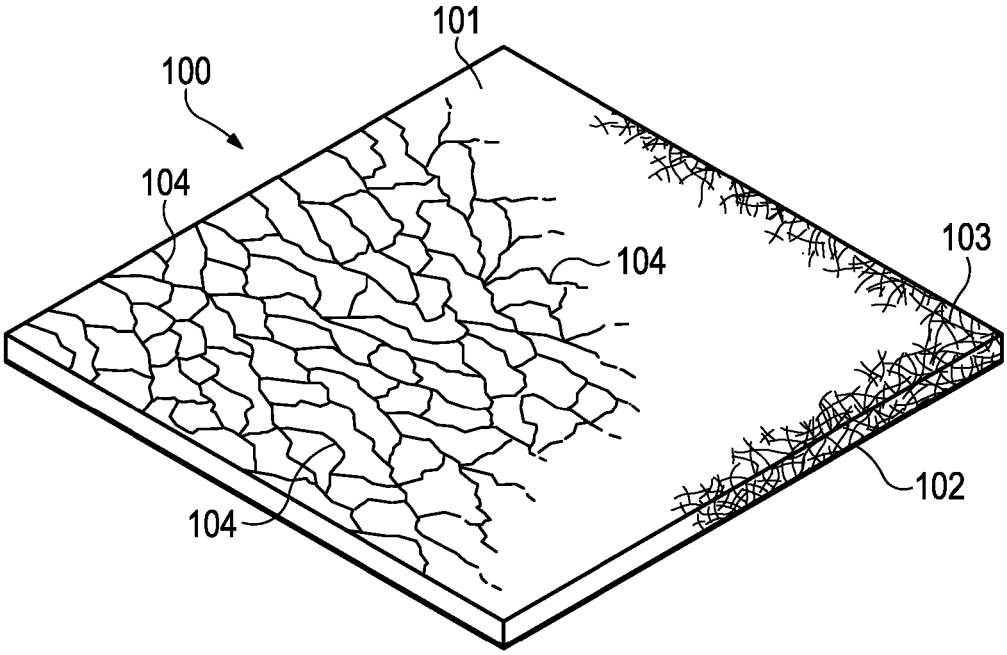
Figure 3E:
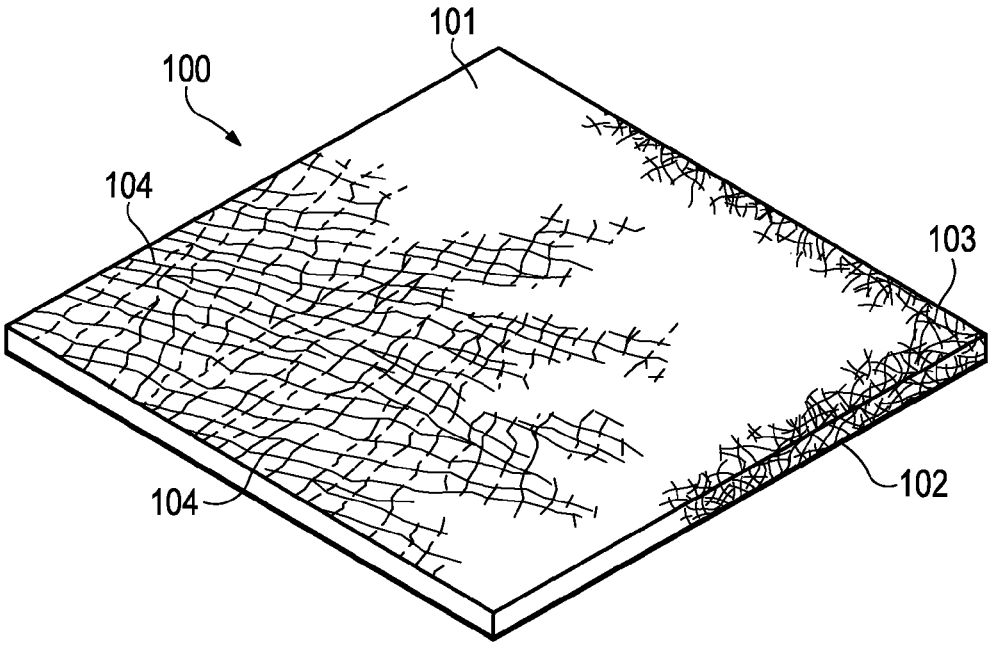
Figure 3F:
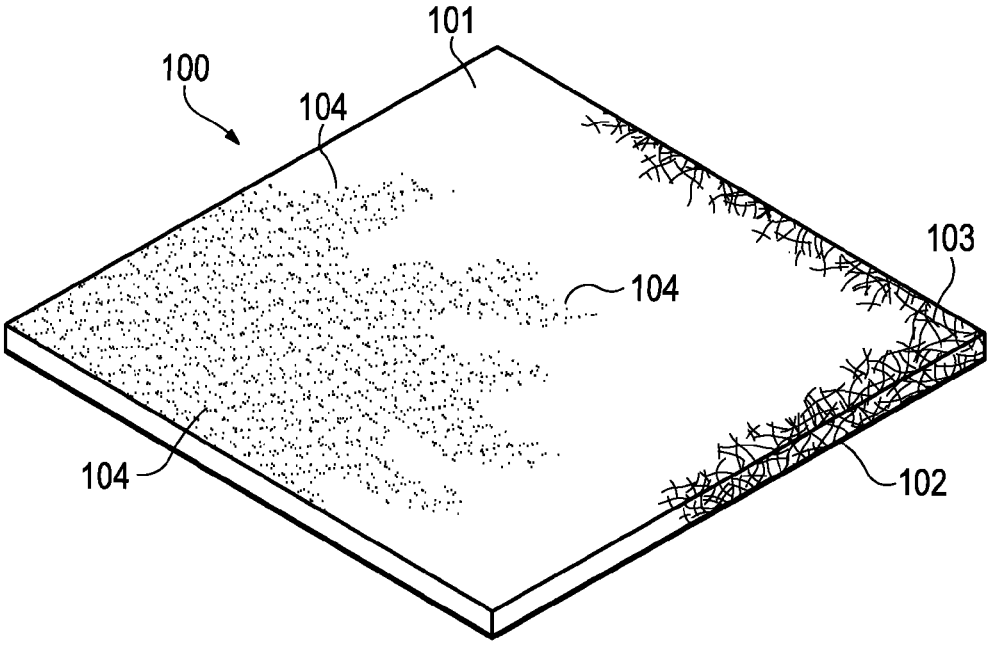

The plurality of curved, wave-like, or undulating lines provide an example of one configuration that is suitable for texture 104. As another example, FIG. 3A depicts texture 104 as being various x-shaped features. Texture 104 may also be utilized to convey information, as in the series of alpha-numeric characters that are formed in first surface 101 in FIG. 3B. Similarly, texture 104 may be symbols, trademarks, indicia, drawings, or any other feature that may be formed in first surface 101. Although texture 104 may be generally linear features, texture 104 may also be larger indentations in areas of first surface 101, as depicted in FIG. 3C. Texture 104 may also be utilized to impart the appearance of other materials to textured element 100. As an example, texture 104 may include a plurality of elongate and non-linear indentations in first surface 101, as depicted in FIGS. 3D and 3E, that impart the appearance of leather or a leather-style grain to textured element 100. More particularly, texture 104 includes indentations in first surface 101 that may (a) cross each other or be separate from each other, (b) exhibit varying or constant widths and depths, or (c) appear randomly-located. As another example, texture 104 may include a plurality of randomly-located indentations in first surface 101, as depicted in FIG. 3F, that also impart the appearance of leather or a leather-style grain to textured element 100. An advantage of forming texture 104 to exhibit the appearance of leather is that textured element 100 may be utilized as a synthetic leather or a substitute for leather or conventional synthetic leather. Accordingly, the configuration of texture 104 may vary significantly to include a variety of shapes and features.

Figure 4A:
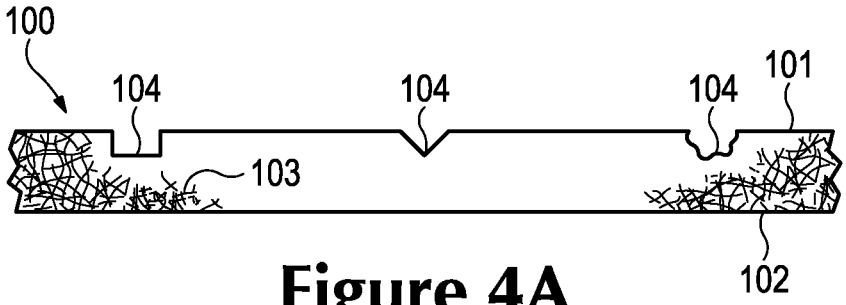
FIGS. 4A-4F are cross-sectional views corresponding with FIG. 2 and depicting additional configurations of the textured non-woven textile.
Figure 4B:
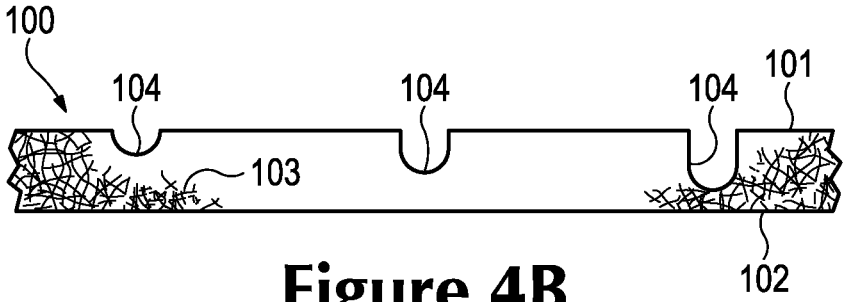
Figure 4C:
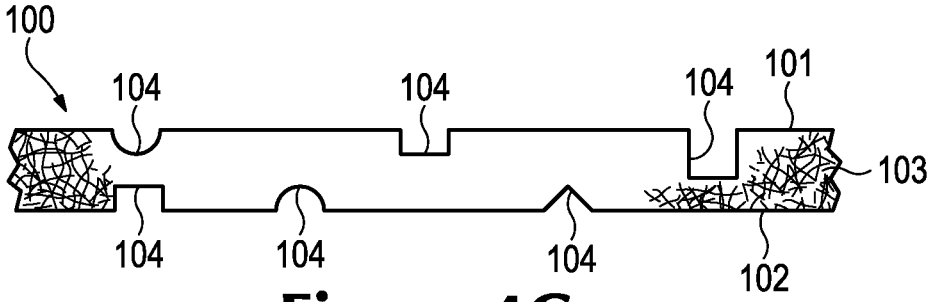
Figure 4D:
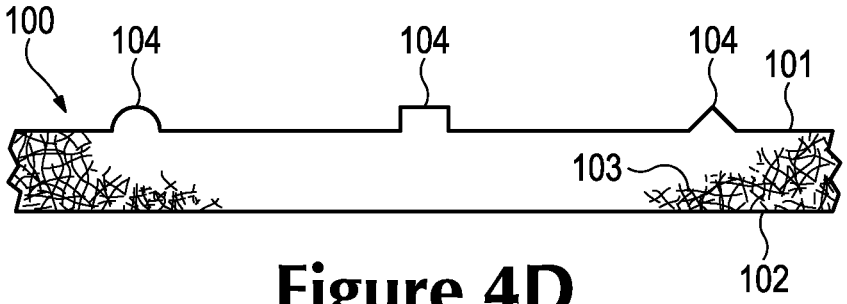
Figure 4E:
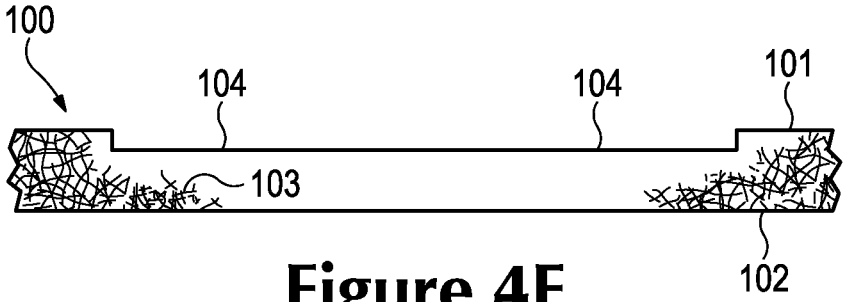

The discontinuities in first surface 101 that form texture 104 may have the hemispherical, curved, or generally rounded shape noted above. In other examples, however, the discontinuities forming texture 104 may have other shapes or configurations. As an example, FIG. 4A depicts texture 104 as being squared, V-shaped, and irregular indentations. Referring to FIG. 4B, the depth of the indentations forming texture 104 may vary. Additionally, FIG. 4C depicts texture 104 as being formed in both of surfaces 101 and 102, with some indentations being aligned and some unaligned. Texture 104 may also be raised in comparison with other areas of first surface 101, as depicted in FIG. 4D, to form bumps, bulges, or other outwardly-protruding features. Moreover, texture 104 may be a relatively large indentation, as depicted in FIG. 4E, that may correspond with the areas of texture 104 in FIG. 3C. Accordingly, the configuration of texture 104 may vary significantly to include a variety of indentations, depressions, or other discontinuities in first surface 101.

Figure 4F:
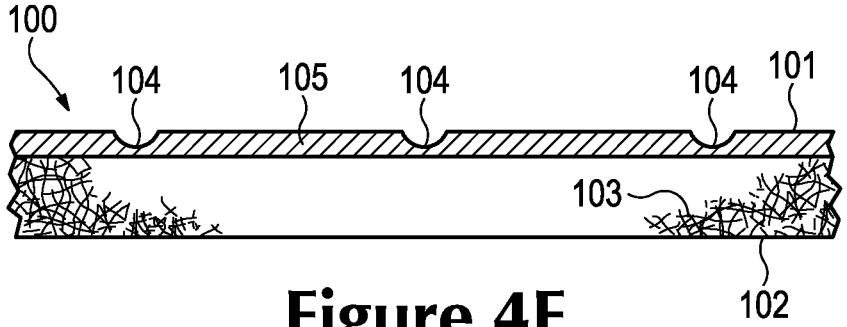

As another example of textured element 100, FIG. 4F depicts first surface 101 as being formed from a skin layer 105. For purposes of comparison, filaments 103 extend between and form surfaces 101 and 102 in each of the configurations discussed above. Skin layer 105, however, may be a layer of polymer material that does not include filaments 103. Moreover, texture 104 may be applied to skin layer 105, thereby forming indentations, depressions, or other discontinuities in portions of first surface 101 formed from skin layer 105. As noted above, texture 104 may impart the appearance of leather or a leather-style grain to textured element 100. The combination of skin layer 105 and the appearance of leather (e.g., through texture 104) may provide an enhanced synthetic leather or substitute for leather or conventional synthetic leather.

Fibers are often defined, in textile terminology, as having a relatively short length that ranges from one millimeter to a few centimeters or more, whereas filaments are often defined as having a longer length than fibers or even an indeterminate length. As utilized within the present document, the term "filament" or variants thereof is defined as encompassing lengths of both fibers and filaments from the textile terminology definitions. Accordingly, filaments 103 or other filaments referred to herein may generally have any length. As an example, therefore, filaments 103 may have a length that ranges from one millimeter to hundreds of meters or more.

Filaments 103 include a thermoplastic polymer material. In general, a thermoplastic polymer material melts when heated and returns to a solid state when cooled. More particularly, the thermoplastic polymer material transitions from a solid state to a softened or liquid state when subjected to sufficient heat, and then the thermoplastic polymer material transitions from the softened or liquid state to the solid state when sufficiently cooled. As such, the thermoplastic polymer material may be melted, molded, cooled, re-melted, re-molded, and cooled again through multiple cycles. Thermoplastic polymer materials may also be welded or thermal bonded to other textile elements, plates, sheets, polymer foam elements, thermoplastic polymer elements, thermoset polymer elements, or a variety of other elements formed from various materials. In contrast with thermoplastic polymer materials, many thermoset polymer materials do not melt when heated, simply burning instead. Although a wide range of thermoplastic polymer materials may be utilized for filaments 103, examples of some suitable thermoplastic polymer materials include thermoplastic polyurethane, polyamide, polyester, polypropylene, and polyolefin. Although any of the thermoplastic polymer materials mentioned above may be utilized for textured element 100, thermoplastic polyurethane provides various advantages. For example, various formulations of thermoplastic polyurethane are elastomeric and stretch over one-hundred percent, while exhibiting relatively high stability or tensile strength. In comparison with some other thermoplastic polymer materials, thermoplastic polyurethane readily forms thermal bonds with other elements, as discussed in greater detail below. Also, thermoplastic polyurethane may form foam materials and may be recycled to form a variety of products.

Although each of filaments 103 may be entirely formed from a single thermoplastic polymer material, individual filaments 103 may also be at least partially formed from multiple polymer materials. As an example, an individual filament 103 may have a sheath-core configuration, wherein an exterior sheath of the individual filament 103 is formed from a first type of thermoplastic polymer material, and an interior core of the individual filament 103 is formed from a second type of thermoplastic polymer material. As a similar example, an individual filament 103 may have a bi-component configuration, wherein one half of the individual filament 103 is formed from a first type of thermoplastic polymer material, and an opposite half of the individual filament 103 is formed from a second type of thermoplastic polymer material. In some configurations, an individual filament 103 may be formed from both a thermoplastic polymer material and a thermoset polymer material with either of the sheath-core or bi-component arrangements. Although all of filaments 103 may be entirely formed from a single thermoplastic polymer material, filaments 103 may also be formed from multiple polymer materials. As an example, some of filaments 103 may be formed from a first type of thermoplastic polymer material, whereas other filaments 103 may be formed from a second type of thermoplastic polymer material. As a similar example, some of filaments 103 may be formed from a thermoplastic polymer material, whereas other filaments 103 may be formed from a thermoset polymer material. Accordingly, each filaments 103, portions of filaments 103, or at least some of filaments 103 may be formed from one or more thermoplastic polymer materials.

The thermoplastic polymer material or other materials utilized for textured element 100 (i.e., filaments 103) may be selected to have various stretch properties, and the materials may be considered elastomeric. Depending upon the specific product that textured element 100 will be incorporated into, textured element 100 or filaments 103 may stretch between ten percent to more than eight-hundred percent prior to tensile failure. For many articles of apparel, in which stretch is an advantageous property, textured element 100 or filaments 103 may stretch at least one-hundred percent prior to tensile failure. As a related matter, thermoplastic polymer material or other materials utilized for textured element 100 (i.e., filaments 103) may be selected to have various recovery properties. That is, textured element 100 may be formed to return to an original shape after being stretched, or textured element 100 may be formed to remain in an elongated or stretched shape after being stretched. Many products that incorporate textured element 100, such as articles of apparel, may benefit from properties that allow textured element 100 to return or otherwise recover to an original shape after being stretched by one-hundred percent or more.

Textured element 100 may be formed as a spunbonded or meltblown material. Whereas spunbonded non-woven textiles are formed from filaments having a cross-sectional thickness of 10 to 100 microns, meltblown non-woven textiles are formed from filaments having a cross-sectional thickness of less than 10 microns. In many configurations, therefore, an individual filament 103 will have a thickness between 1 micron and 100 microns. Textured element 100 may be either spunbonded, meltblown, or a combination of spunbonded and meltblown. Moreover, textured element 100 may be formed to have spunbonded and meltblown layers, or may also be formed such that filaments 103 are combinations of spunbonded and meltblown.

In addition to differences in the thickness of individual filaments 103, the overall thickness of textured element 100 may vary significantly. With reference to the various figures, the thickness of textured element 100 and other elements may be amplified or otherwise increased to show details or other features associated with textured element 100, thereby providing clarity in the figures. For many applications, however, a thickness of textured element 100 may be in a range of 0.5 millimeters to 10.0 millimeters, but may vary considerably beyond this range. For many articles of apparel, for example, a thickness of 1.0 to 3.0 millimeters may be appropriate, although other thicknesses may be utilized.

Based upon the above discussion, textured element 100 has the general structure of a non-woven textile formed filaments 103. At least one of surfaces 101 and 102 includes texture 104, which may have various configurations. For example, texture 104 may be lines, letters, numbers, symbols, or areas. Texture 104 may also resemble biological matter, such as leather. Additionally, the various filaments 103 may be formed from a thermoplastic polymer material. As discussed below, the thermoplastic polymer material in textured element 100 provides significant variety in the manner in which textured element 100 may be used or incorporated into products.

An advantage of textured element 100 relates to versatility. More particularly, textured element 100 may be (a) modified in numerous ways to impart various properties, including fusing of regions, molding to have a three-dimensional shape, and stitching, (b) joined with other elements through thermal bonding, (c) incorporated into various products, and (d) recycled, for example. Additional information relating to these concepts may be found in (a) U.S. patent application Ser. No. 12/367,274, filed on 6 Feb. 2009 and entitled Thermoplastic Non-Woven Textile Elements and (b) U.S. patent application Ser. No. 12/579,838, filed on 15 Oct. 2009 and entitled Textured Thermoplastic Non-Woven Elements, both applications being incorporated herein by reference. Moreover, texture 104 may be utilized with textured element 100 when modified, joined, or incorporated into products to enhance aesthetic and physical properties (e.g., strength, abrasion resistance, permeability) of the products.

Manufacturing Process

Figure 5:
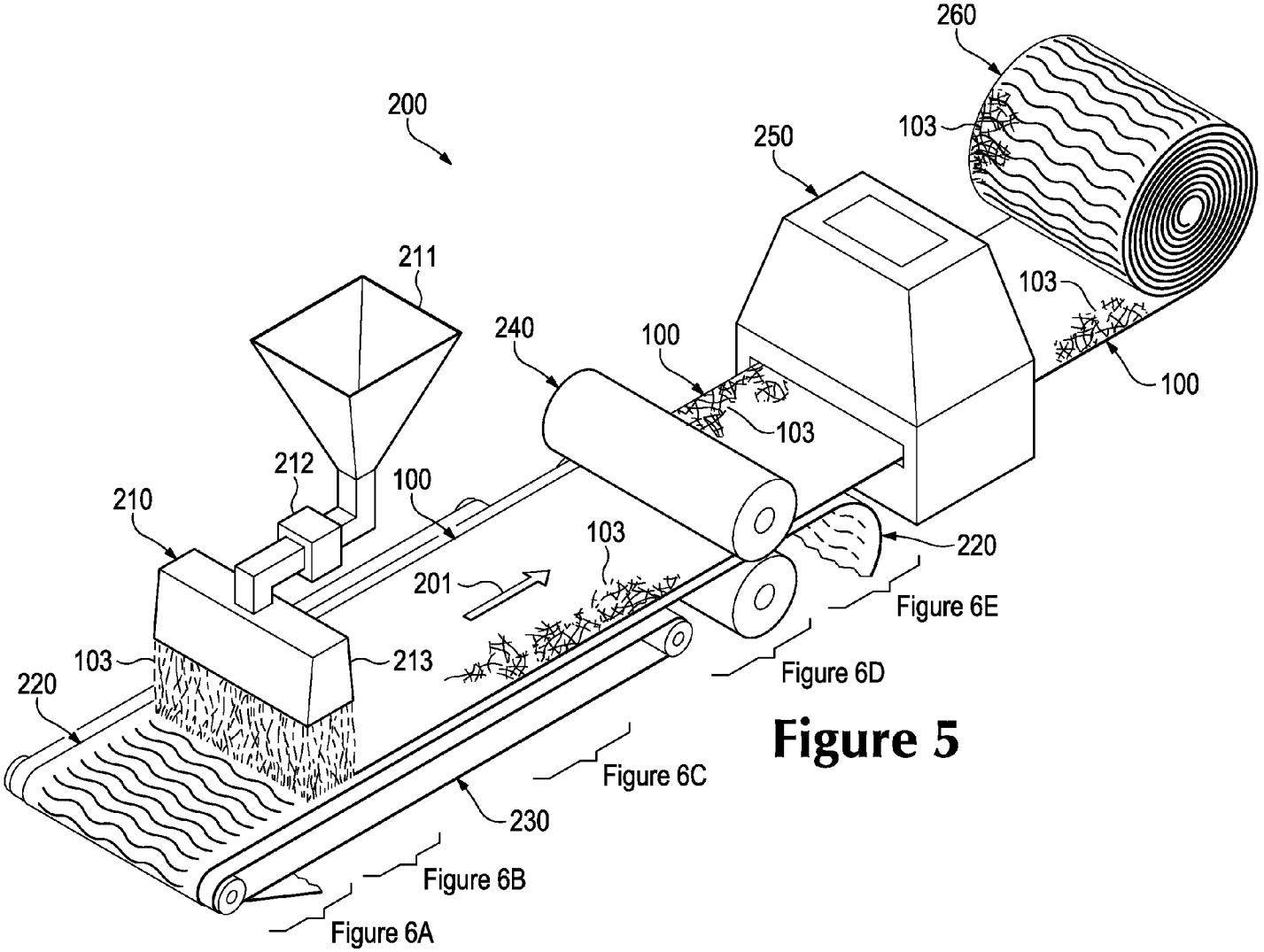
FIG. 5 is a schematic perspective view of a system utilized in a manufacturing process for the textured non-woven textile.

A system 200 that is utilized in a process for manufacturing, forming, or otherwise making textured element 100 is depicted in FIG. 5. Although system 200 is shown as manufacturing the configuration of textured element 100 depicted in FIGS. 1 and 2, system 200 may be utilized to make other non-woven textiles, a variety of textured non-woven textiles, and any of the configurations of textured element 100 depicted in FIGS. 3A-3F and 4A-4F. Moreover, while system 200 provides an example of one approach to manufacturing textured element 100, a variety of other systems may also be used. Similarly, various modified versions of system 200, which may be discussed below, may also produce textured element 100.

The primary elements of system 200 are a filament extruder 210, a release paper 220, a conveyor 230, a pair of rollers 240, a post-processing apparatus 250, and a collection roll 260. In general operation, a plurality of filaments 103 are extruded from or otherwise formed by filament extruder 210. The individual filaments 103 are deposited or collected upon release paper 220 to form a layer of filaments 103. Release paper 220 moves with conveyor 230 toward rollers 240, thereby moving the layer of filaments 103 toward rollers 240. The combination of release paper 220 and the layer of filaments 103 passes through and is compressed by rollers 240 to (a) provide uniform thickness to textured element 100 and (b) ensure that a texture of release paper 220 is imprinted upon the layer of filaments 103. Once compressed, the layer of filaments 103 and release paper 220 are separated. The layer of filaments 103 then enters post-processing apparatus 250 to enhance the properties of textured element 100. Once post-processing is complete, a relatively long length of textured element 100 is gathered on collection roll 260.

Figure 6A:
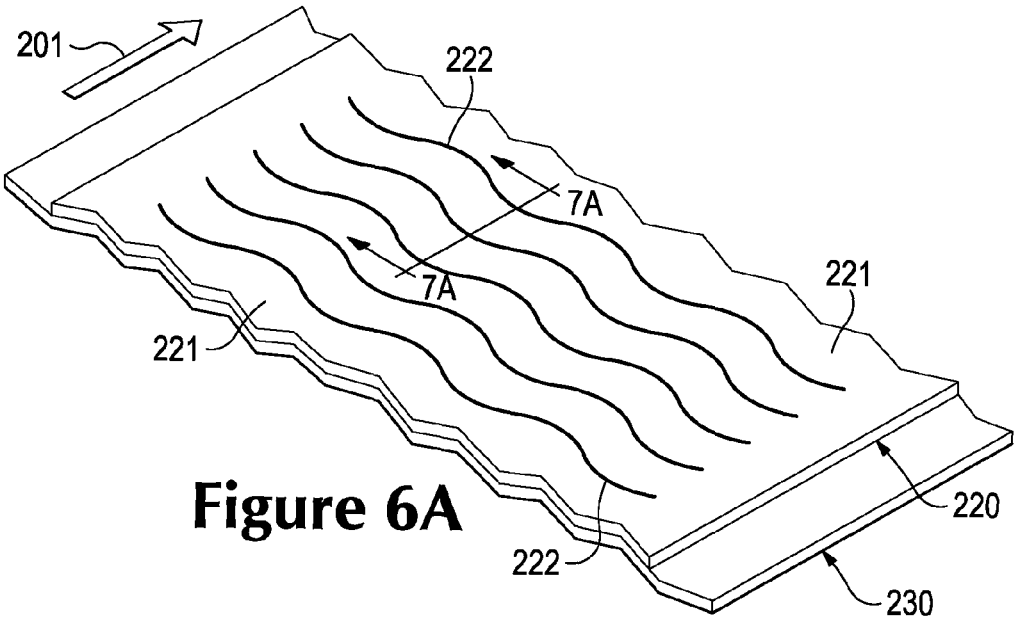
FIGS. 6A-6E are perspective views of portions of the manufacturing process.
Figure 7A:
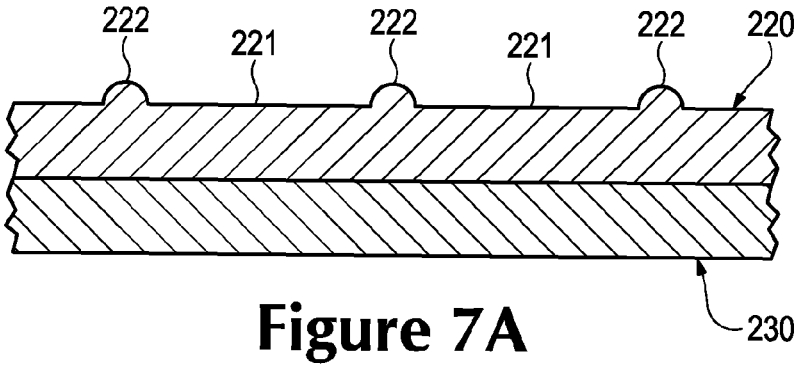
FIGS. 7A-7E are cross-sectional views of the manufacturing process, as respectively defined in FIGS. 6A-6E.

The manufacturing process for textured element 100 will now be discussed in greater detail. To begin the manufacturing process, a plurality of individual filaments 103, which are substantially separate and unjoined at this point, are extruded from or otherwise formed by filament extruder 210. The primary components of filament extruder 210 are a hopper 211, a melt pump 212, and a spinneret 213. In forming filaments 103, a thermoplastic polymer material (e.g., polymer pellets) is placed in hopper 211, melted in melt pump 212, and then extruded from spinneret 213. Although the thickness of filaments 103 may vary, filaments 103 generally have a thickness in a range of a range of 1 to 100 microns. The non-woven textile of textured element 100 may, therefore, be either spunbonded, meltblown, or a combination of spunbonded and meltblown As the individual filaments 103 are being extruded from filament extruder 210, release paper 220 and conveyor 230 are moving below spinneret 213. For purposes of reference in various figures, the direction in which release paper 220 and conveyor 230 are moving is identified by an arrow 201. Referring to FIGS. 6A and 7A, a textured surface 221 of release paper 220 faces upward and is exposed. Textured surface 221 includes various protrusions 222 that impart texture to release paper 220. Although release paper 220 and textured surface 221 are generally planar, protrusions 222 project upward from release paper 220. As depicted, protrusions 222 (a) are curved, wave-like, or undulating lines and (b) have a hemispherical, curved, or generally rounded shape, both of which are similar to texture 104 in FIGS. 1 and 2. In general, protrusions 222 have a height in a range of 0.05 to 3.0 millimeters, although the height may vary. In this range, protrusions 222 are more than mere irregularities in textured surface 221, but are not so large as to impart a three-dimensional or generally non-planar aspect to release paper 220. As such, protrusions 222 have a height that corresponds with general dimensions of textures in textiles and similar products. As an alternative to protrusions 222, textured surface 221 may form depressions or indentations that would also impart a texture to textured element 100. Although a width of release paper 220 (i.e., a dimension that is perpendicular to arrow 201) may vary, many configurations have a width of at least 30 centimeters to form textured element 100 with sufficient area to make apparel and a variety of other products, with protrusions 222 extending across at least a portion of this width.

Release paper 220 is utilized to provide an example of one manner of incorporating a textured surface into system 200. In general, release paper 220 is a relatively thin layer that (a) does not bond or otherwise join with the thermoplastic polymer material forming textured element 100 and (b) includes a texture (i.e., protrusions 222 upon textured surface 221) that is suitable for imparting a corresponding texture (i.e., texture 104) to textured element 100. Despite the use of "paper" in the term "release paper," release paper 220 may be solely or primarily formed from polymer materials or other materials that are not commonly found in paper (e.g., wood pulp). As alternatives to release paper 220, other textured materials may be utilized, such as a textured metallic film. Moreover, release paper 220 or corresponding components may be absent from system 200 when, for example, a surface of conveyor 230 is textured.

Figure 6B:
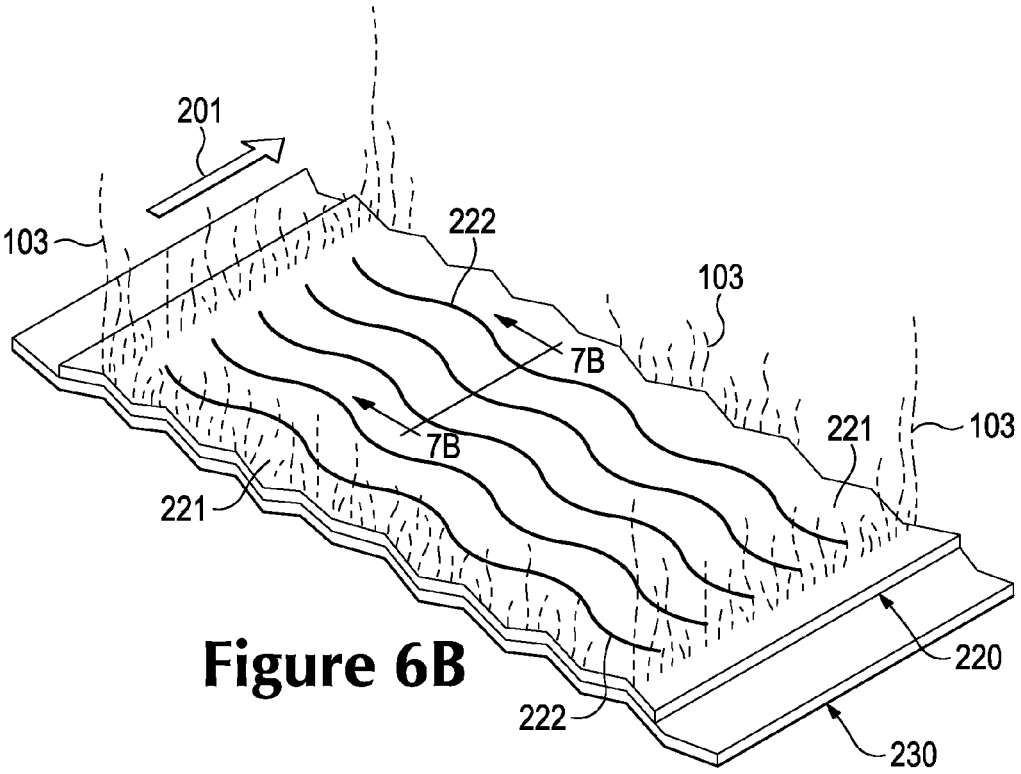
Figure 7B:
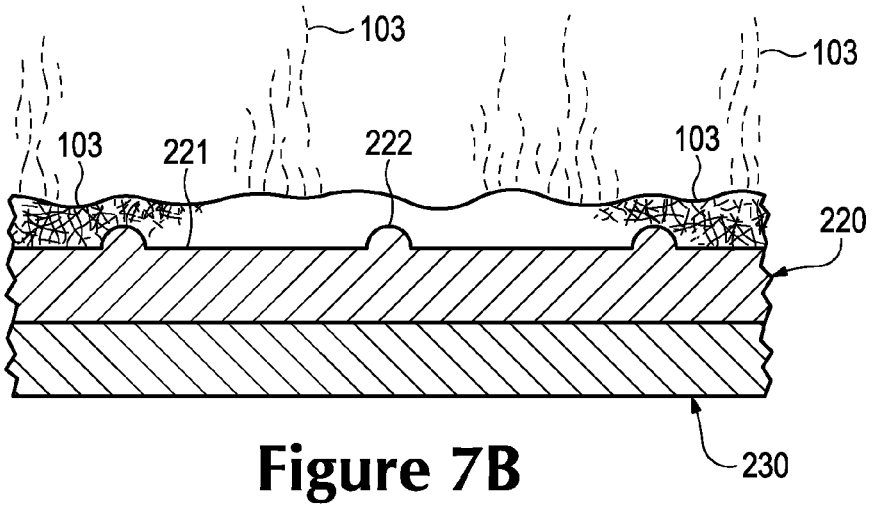

Continuing with the manufacturing of textured element 100, release paper 220 moves with conveyor 230 to a position that is under or adjacent to spinneret 213 of filament extruder 210. Although filaments 103 are substantially separate and unjoined when exiting filament extruder 210, the individual filaments 103 are deposited or collected upon release paper 220 to begin the process of forming the non-woven textile of textured element 100, as depicted in FIGS. 6B and 7B. Moreover filaments 103 extend around and over the various protrusions 222 to begin the process of imparting texture to the layer of filaments 103.

Filament extruder 210 produces a constant and steady volume of filaments 103. Additionally, release paper 220 and conveyor 230 are continually moving relative to spinneret 213 at a constant velocity. As a result, a relatively uniform thickness of filaments 103 collects on release paper 220. By modifying (a) the volume of filaments 103 that are produced by filament extruder 210 or (b) the velocity of release paper 220 and conveyor 230, the layer of filaments 103 deposited upon release paper 220 may have any desired thickness.

Figure 6C:
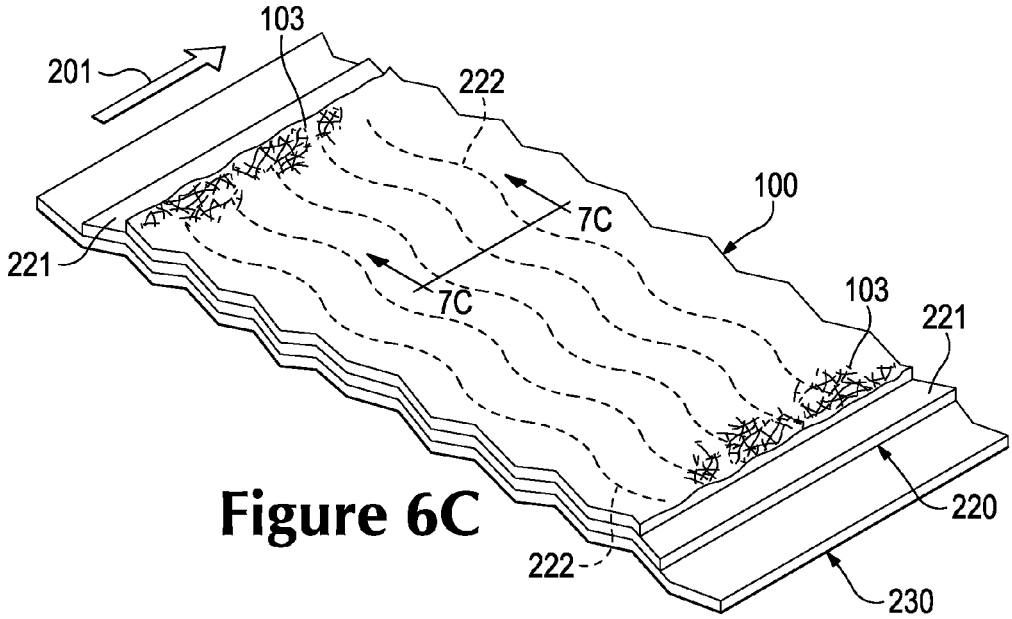
Figure 7C:
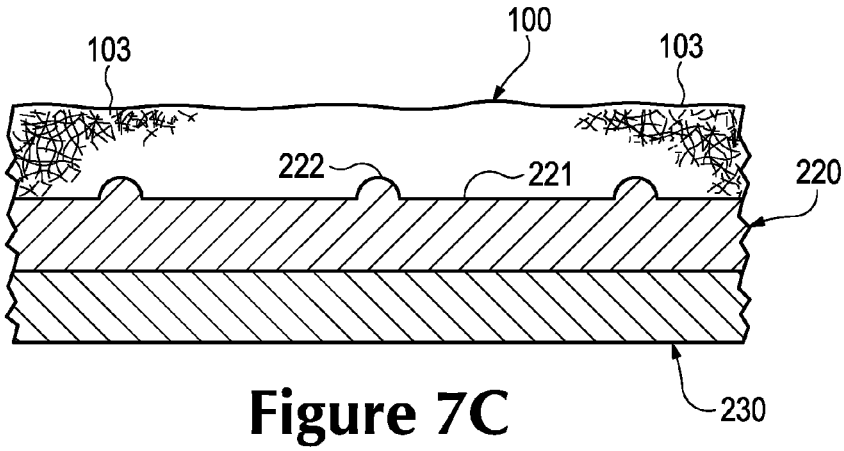
Figure 6D:
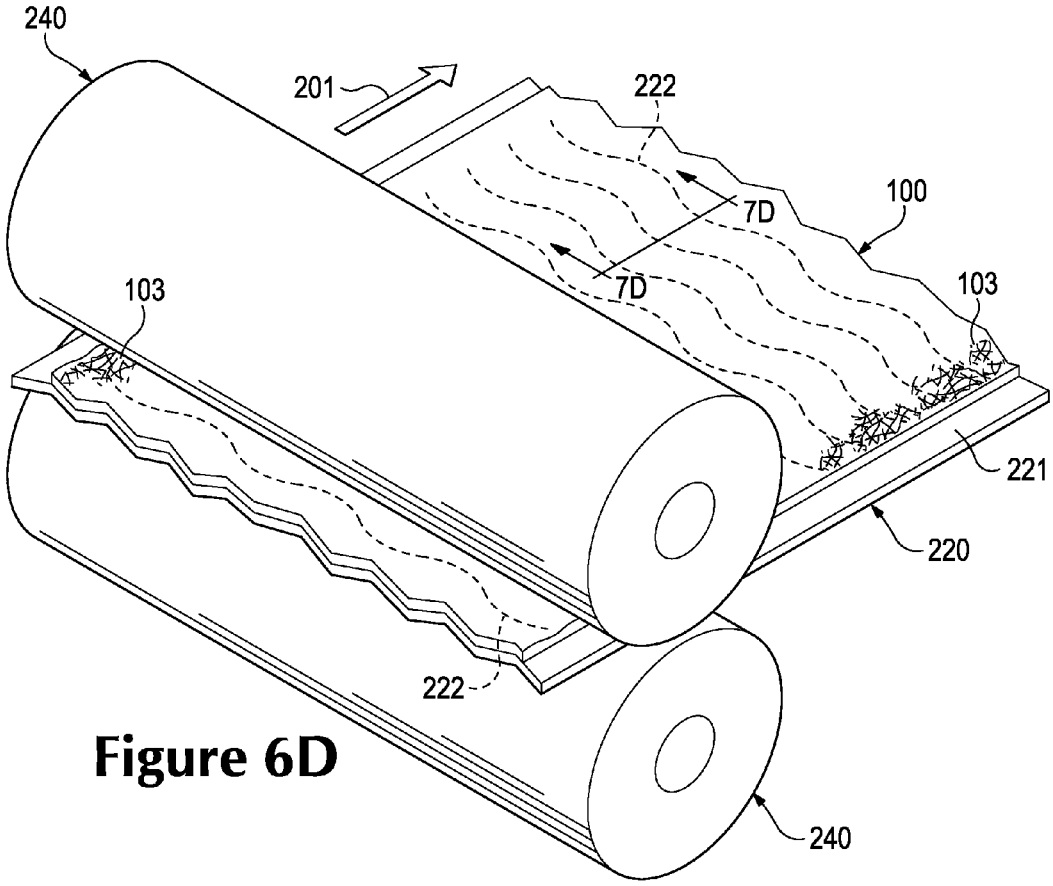
Figure 7D:
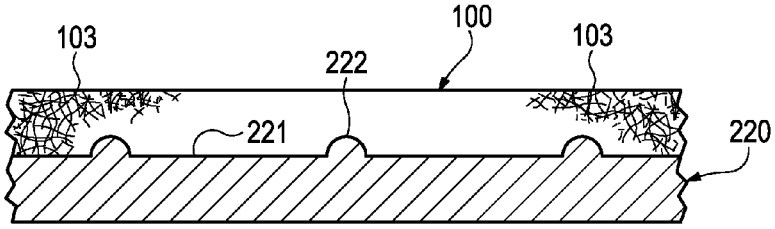

After passing adjacent to filament extruder 210, a complete layer of filaments 103 is collected upon release paper 220, as depicted in FIGS. 6C and 7C. Although the layer of filaments 103 has a relatively uniform thickness, some surface irregularities may be present due to the random manner in which filaments 103 are deposited upon release paper 220. As this stage, release paper 220 and the layer of filaments 103 pass between rollers 240, as depicted in FIGS. 6D and 7D. Rollers 240 compress release paper 220 and the layer of filaments 103 to (a) ensure that the texture from release paper 220 is imprinted upon the layer of filaments 103 and (b) smooth surface irregularities that are present in the layer of filaments 103. In effect, therefore, textured element 100 is compressed against textured surface 221 to provide texture 104 and a uniform thickness. Additionally, rollers 240 may be heated to raise the temperature of the layer of filaments 103 during compression.

Figure 6E:
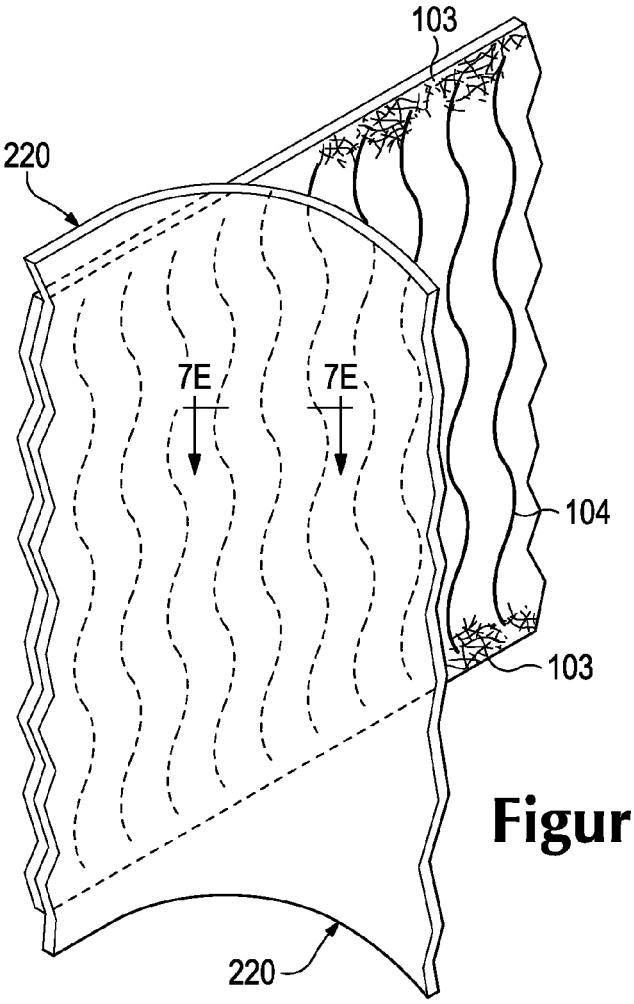
Figure 7E:
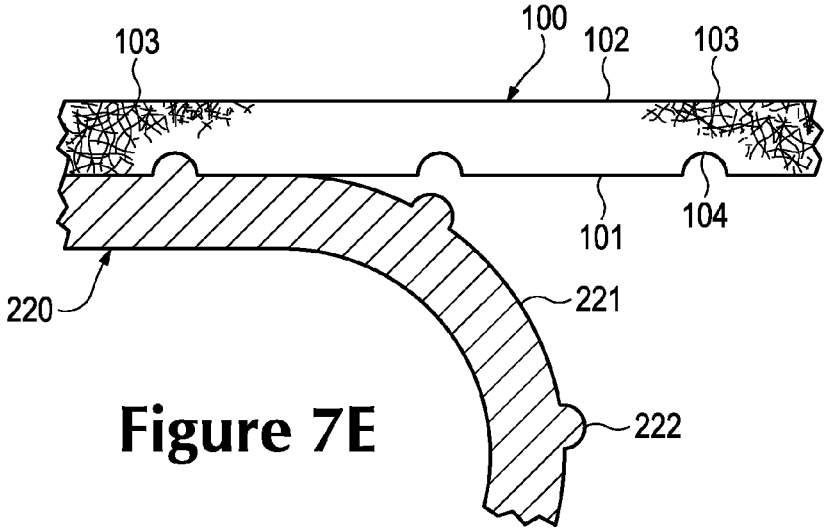

At this point in the manufacturing process for textured element 100, the layer of filaments 103 separates from release paper 220, as depicted in FIGS. 6E and 7E. Although a relatively short distance is shown between rollers 240 and the area where release paper 220 separates from the layer of filaments 103, this distance may be modified to ensure that the layer of filaments 103 is sufficiently cooled. The layer of filaments 103 now enters post-processing apparatus 250. Although shown as a single component, post-processing apparatus 250 may be multiple components that further refine properties of the layer of filaments 103. As an example, post-processing apparatus 250 may pass heated air through the layer of filaments 103 to (a) further bond filaments 103 to each other, (b) heatset filaments 103 or the web formed in textured element 100, (c) shrink the layer of filaments 103, (d) preserve or modify loft and density in the layer of filaments 103, and (e) cure polymer materials in textured element 100. Other post-processing steps may include dying, fleecing, perforating, sanding, sueding, and printing.

Once the layer of filaments 103 exits post-processing apparatus 250, the manufacturing of textured element 100 is effectively complete. Textured element 100 is then accumulated on collection roll 260. After a sufficient length of textured element 100 is accumulated, collection roll 260 may be shipped or otherwise transported to another manufacturer, utilized to form various products, or used for other purposes.

The manufacturing process discussed above has various advantages over conventional processes for forming non-woven textiles. In some conventional processes, calendar rolls are utilized to impart texture. More particularly, calendar rolls are placed within a manufacturing system to (a) heat a non-woven textile and (b) imprint a texture upon the non-woven textile. The process of removing calendar rolls with a first texture, installing calendar rolls with a second texture, and aligning the new calendar rolls may require numerous individuals and significant time. In system 200, however, release paper 220 is replaced with a new release paper 220, which may be performed by fewer individuals and relatively quickly. Additionally, calendar rolls are relatively expensive, whereas release paper 220 is relatively inexpensive. Accordingly, system 220 has the advantages of (a) enhancing efficiency of the manufacturing process, (b) reducing the number of individuals necessary to make modifications to the process, (c) reducing the time that the process is not in operation, and (d) reducing expenses associated with equipment.

Manufacturing Variations

Figure 8:
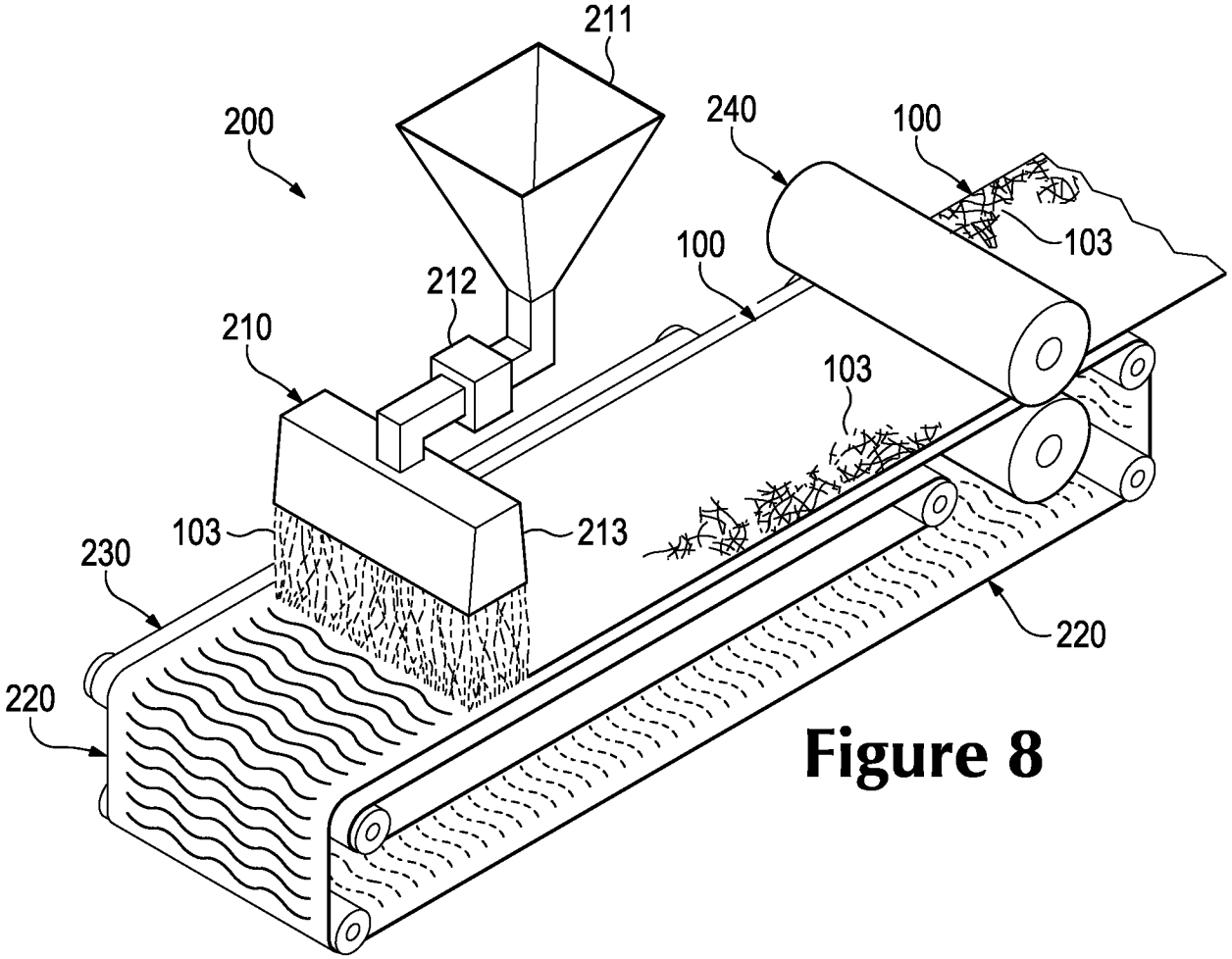
FIG. 8 is a schematic perspective view of another configuration of the system.
Figure 9A:
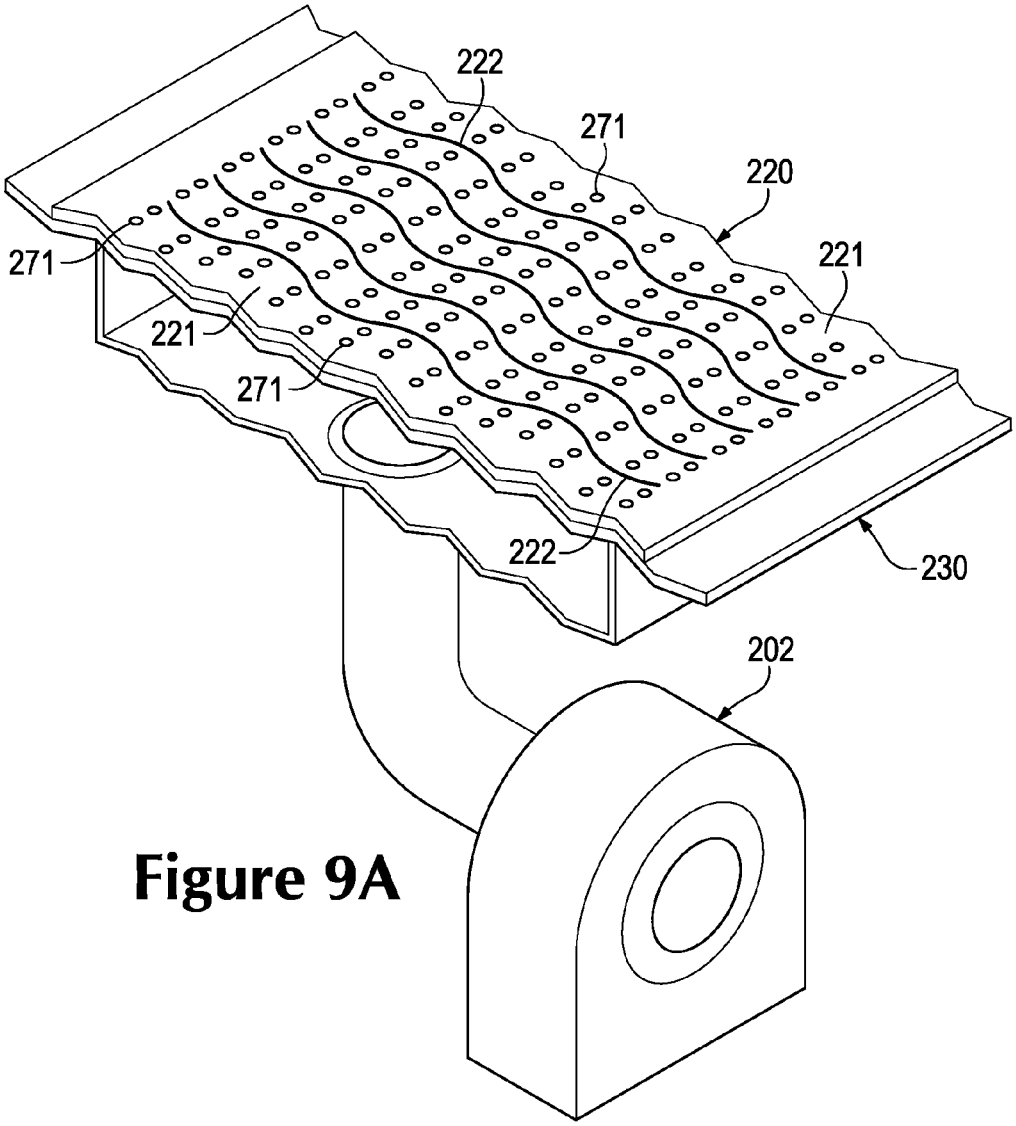
FIGS. 9A-9C are perspective views depicting further configurations of the system.
Figure 9B:
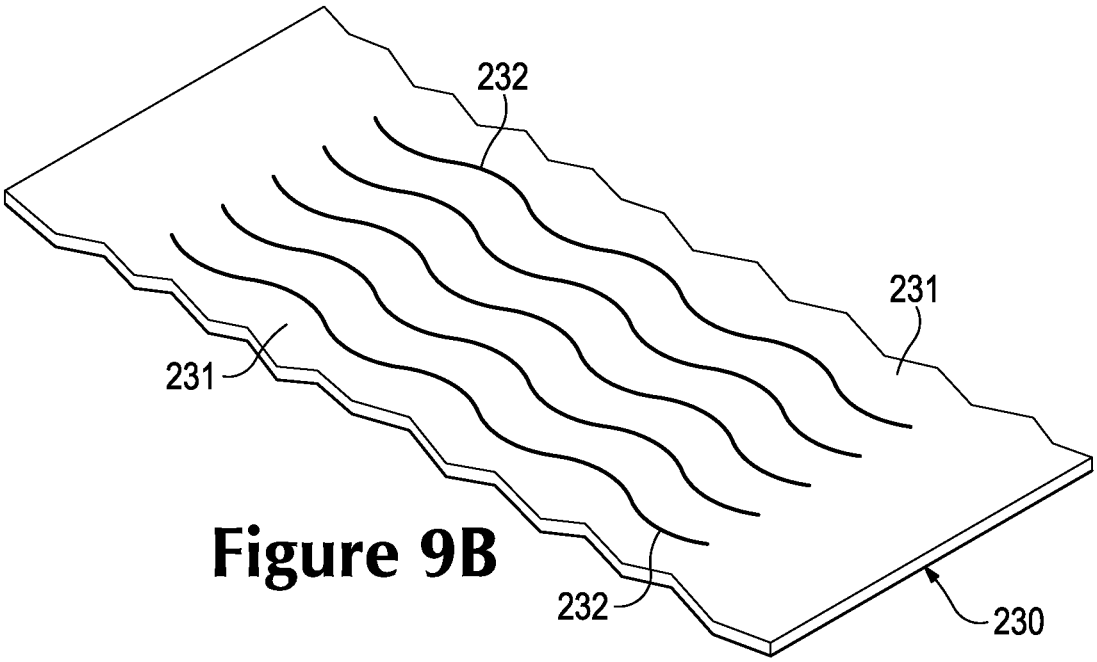
Figure 9C:
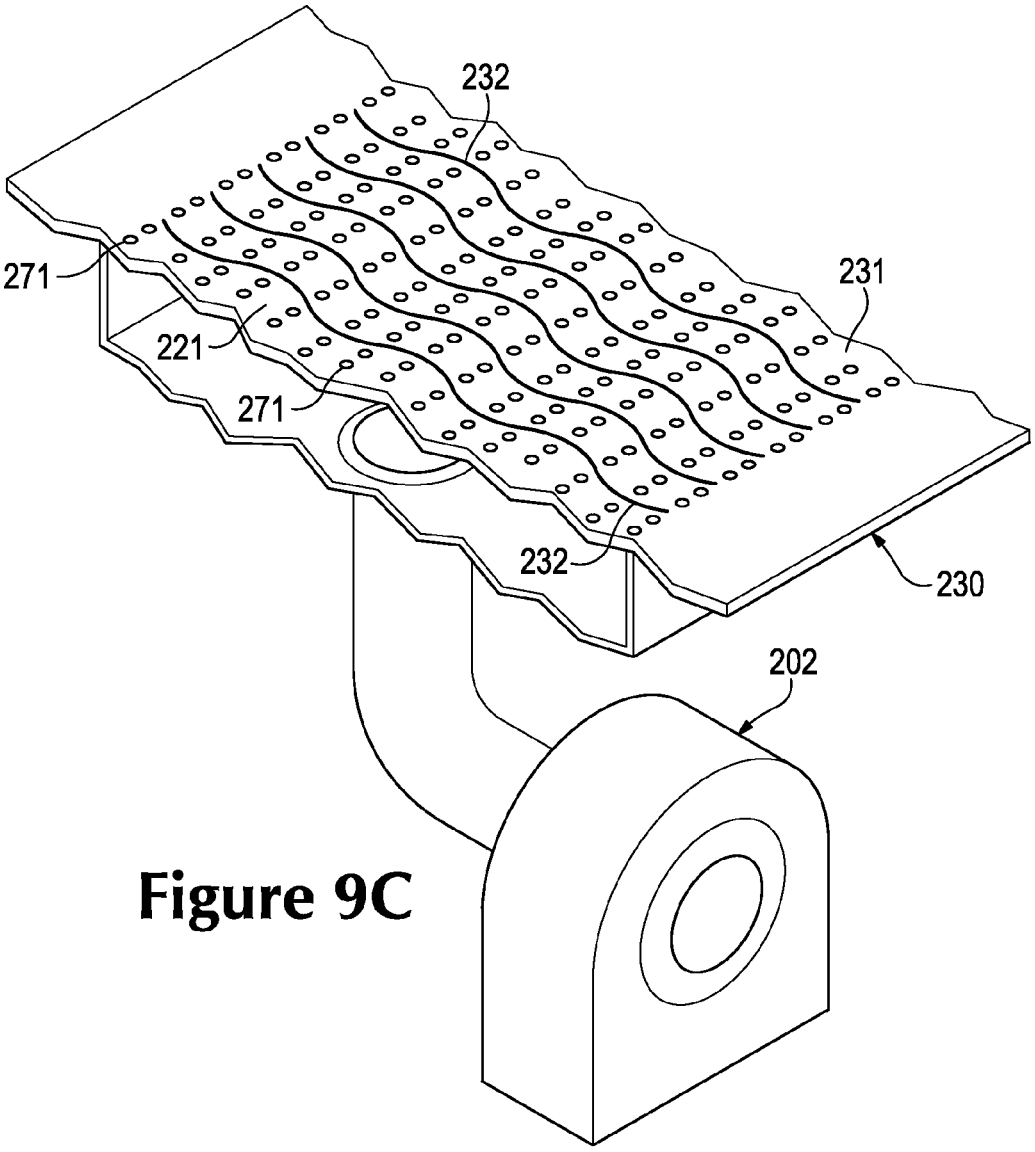
Figure 10:
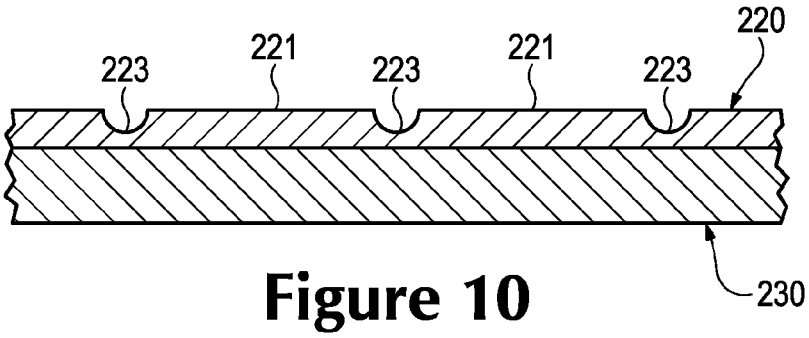
FIG. 10 is a cross-sectional view corresponding with FIG. 7A and depicting another configuration of the system.

The manufacturing process discussed above in relation to system 200 provides an example of a suitable manufacturing process for textured element 100. Numerous variations of the manufacturing process will now be discussed. For example, FIG. 8 depicts a portion of system 200 in which release paper 200 forms an endless loop. That is, release paper 200 follows conveyor 230, passes through rollers 240, and then returns to again follow conveyor 230. In effect, release paper 200 forms a loop and is used repeatedly to form texture 104 on textured element 100. Another example is depicted in FIG. 9A, in which a vacuum pump 202 draws air through various perforations 271 in release paper 220, effectively creating negative pressure at textured surface 221. In operation, the negative pressure may assist with (a) collecting filaments 103 upon textured surface 221 and (b) conforming the layer of filaments 103 to protrusions 222. Referring to FIG. 9B, a configuration is depicted where (a) release paper 220 is absent and (b) conveyor 230 includes a textured surface 231 with various protrusions 232. Continuing with this example, FIG. 9C depicts a configuration wherein vacuum pump 202 draws air through various perforations 271 in conveyor 230. Additionally, FIG. 10 depicts a configuration wherein protrusions 222 of release paper 220 are replaced by a plurality of indentations 223. As with protrusions 222, indentations 223 may have a depth in a range of 0.1 to 3.0 millimeters, for example.

Figure 11A:
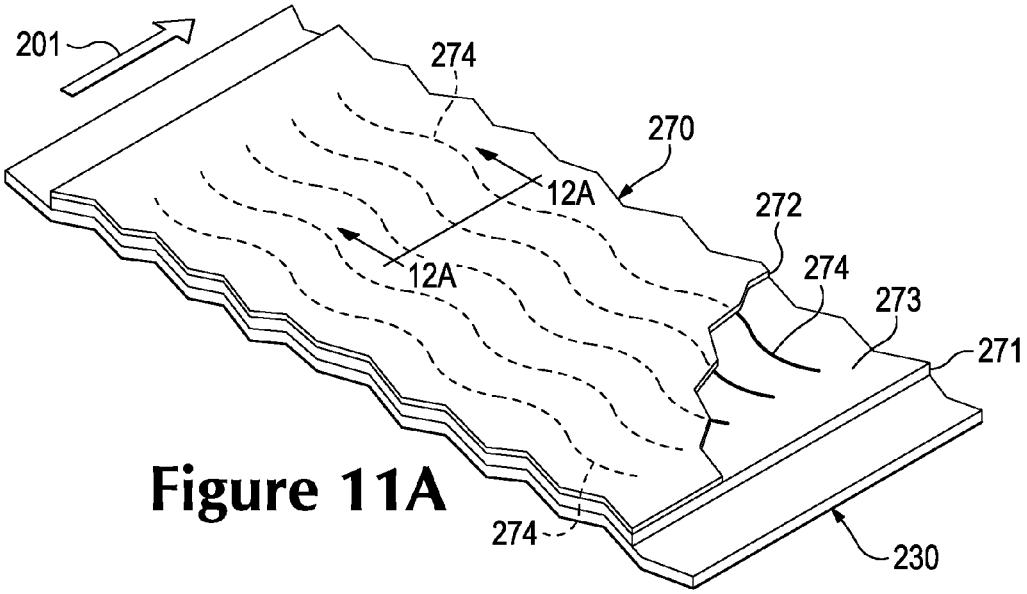
FIGS. 11A-11F are perspective views of another manufacturing process.
Figure 12A:
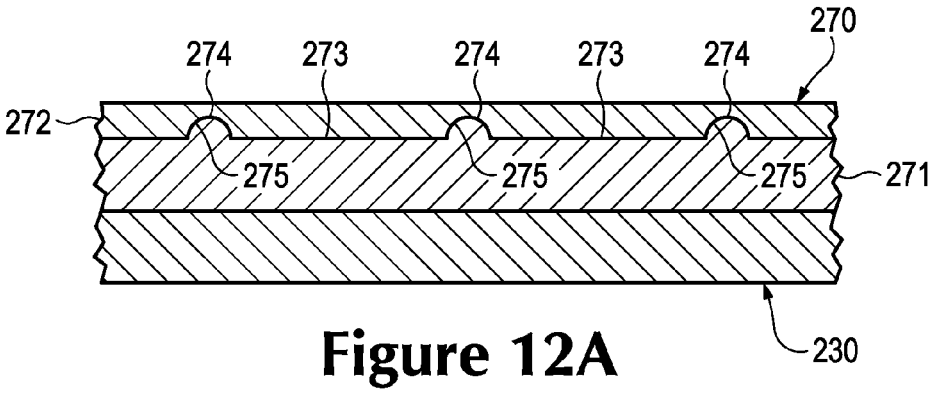
FIGS. 12A-12F are cross-sectional views of the manufacturing process, as respectively defined in FIGS. 12A-12F.

In the manufacturing process discussed above, the non-woven material of textured element 100 is formed upon a textured surface (e.g., textured surface 221). After manufacturing, therefore, the non-woven material of textured element 100 also forms texture 104. That is, texture 104 forms various indentations, depressions, or other discontinuities in the non-woven material. As a variation, FIG. 4F depicts texture 104 as being formed in skin layer 405. A manufacturing process for producing a similar configuration will now be discussed. Referring to FIGS. 11A and 12A, a layered element 270 is located on conveyor 230 and includes a texture layer 271 and a skin layer 272. Texture layer 271 has a textured surface 273 that is in contact with skin layer 271 and includes a plurality of protrusions 274. As an example, texture layer 271 may be similar to release paper 220. Skin layer 272 is a polymer layer and may be formed from the thermoplastic polymer material of filaments 103, a different thermoplastic polymer material, or another polymer. Moreover, skin layer 272 includes various indentations 275 corresponding with protrusions 274.

Figure 11B:
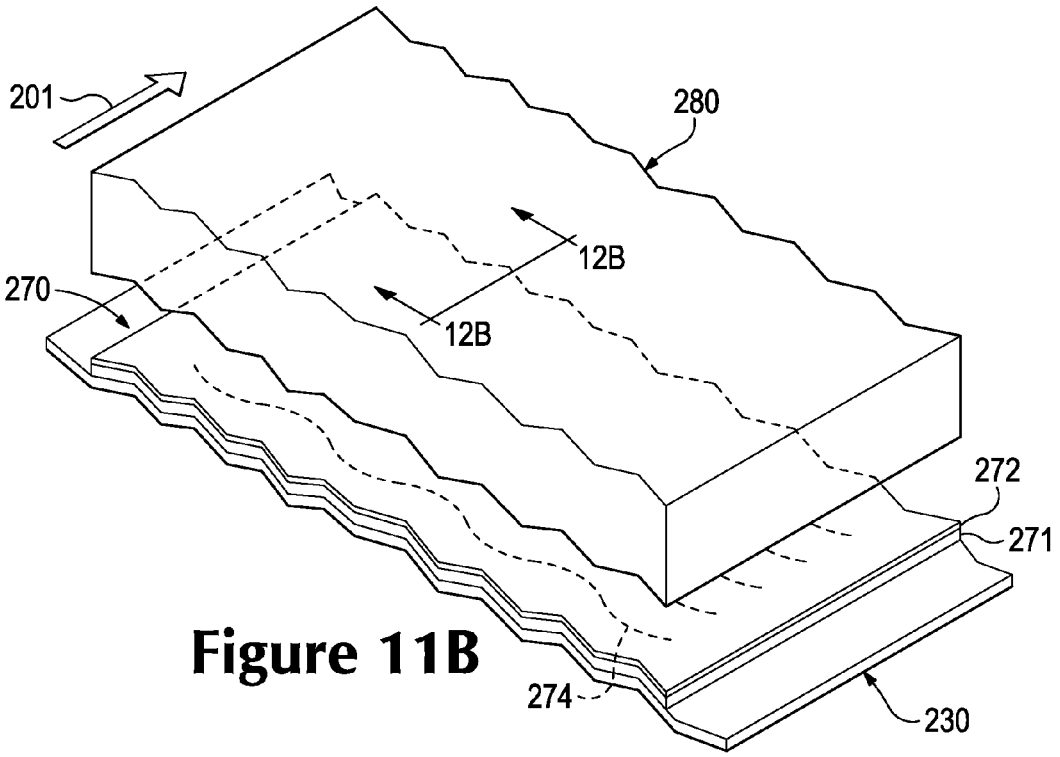
Figure 12B:
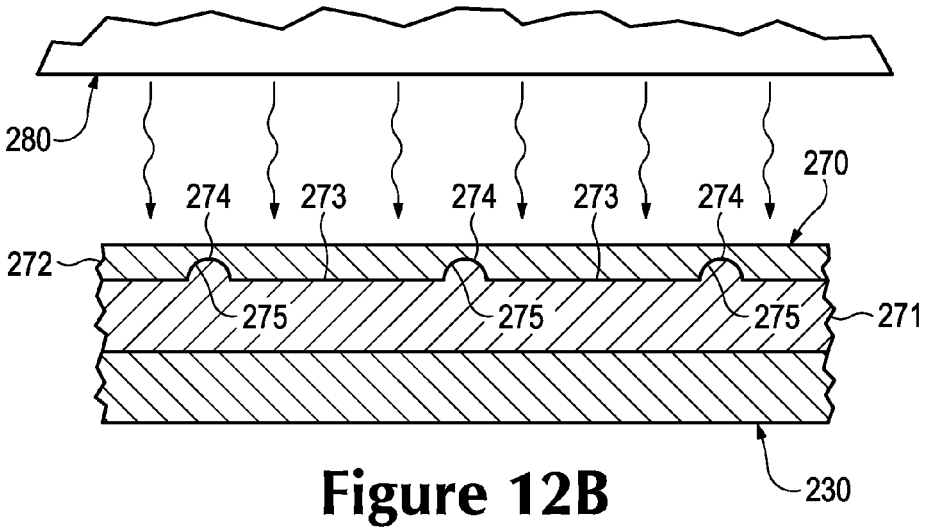
Figure 11C:
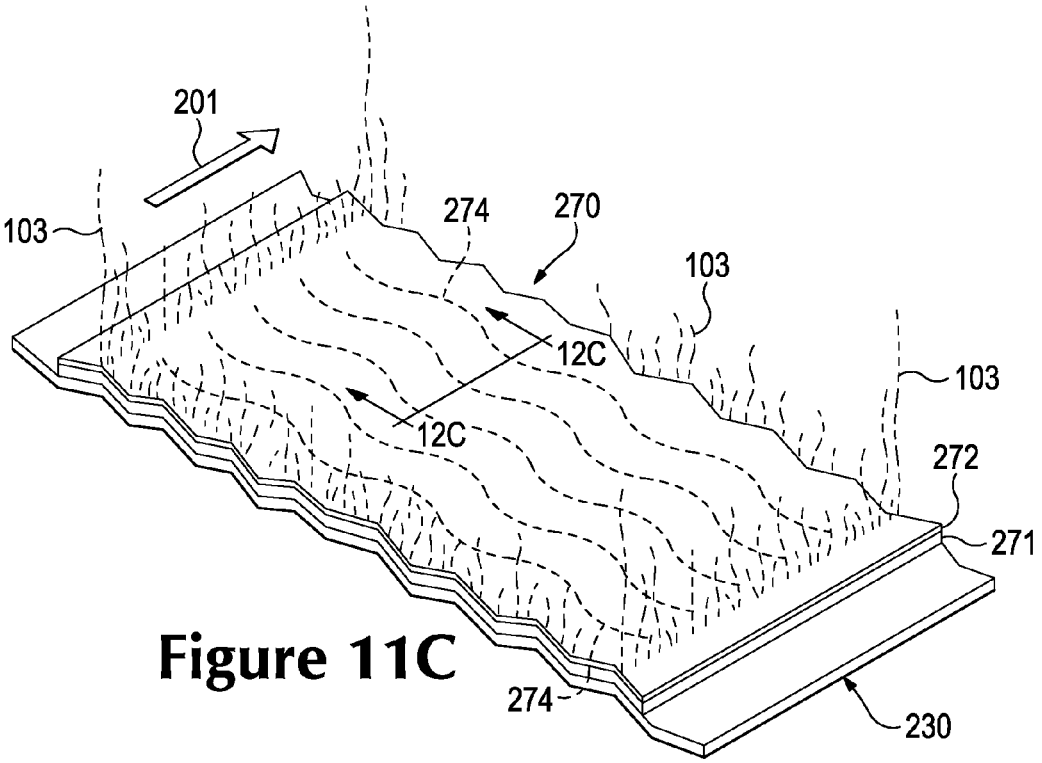
Figure 12C:
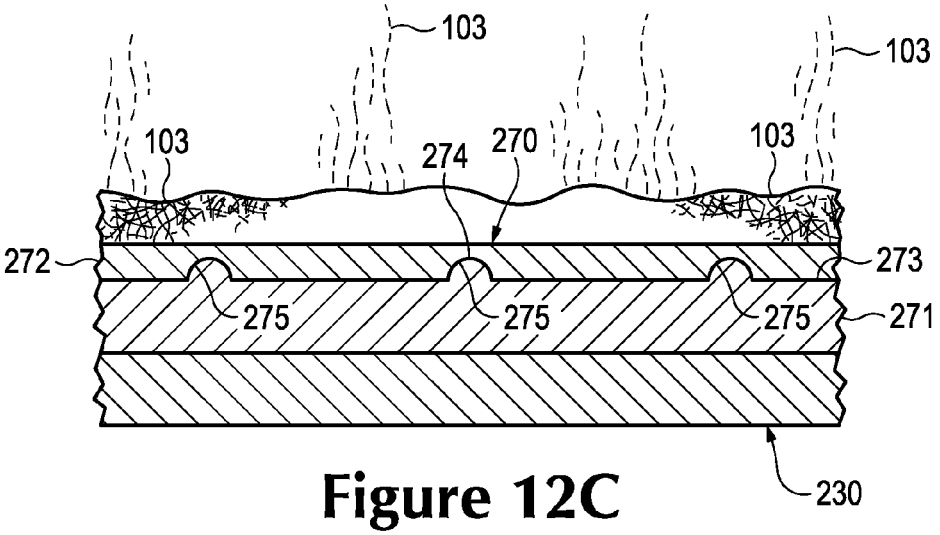

As conveyor 230 moves, layered element 270 is positioned under a heating element 280, as depicted in FIGS. 11B and 12B. Heating element 280 may be an infrared heater, resistance heater, convection heater, or any other device capable of raising the temperature of skin layer 272. Although the temperature of skin layer 272 at this point in the manufacturing process may vary, the temperature of skin layer 272 is often raised to at least the glass transition temperature of the thermoplastic polymer material forming skin layer 272. Following heating, layered element 270 moves with conveyor 230 to a position that is under or adjacent to spinneret 213 of filament extruder 210. Although filaments 103 are substantially separate and unjoined when exiting filament extruder 210, the individual filaments 103 are deposited or collected upon the heated skin layer 272 to begin the process of forming the non-woven textile of textured element 100, as depicted in FIGS. 11C and 12C. Filaments 103 that are in contact with skin layer 272 may bond with skin layer 272.

Figure 11D:
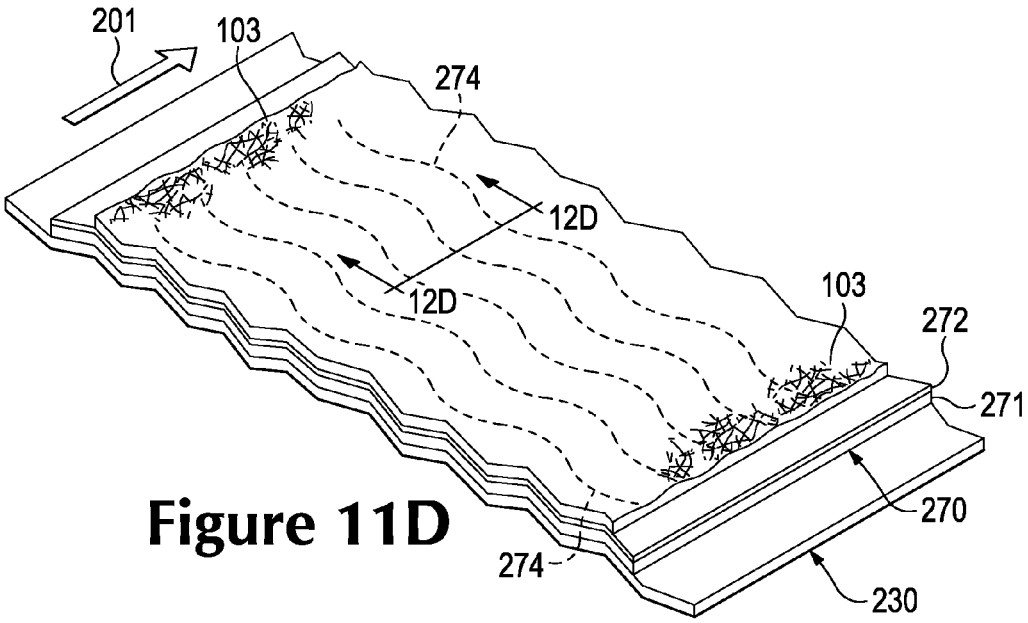
Figure 12D:
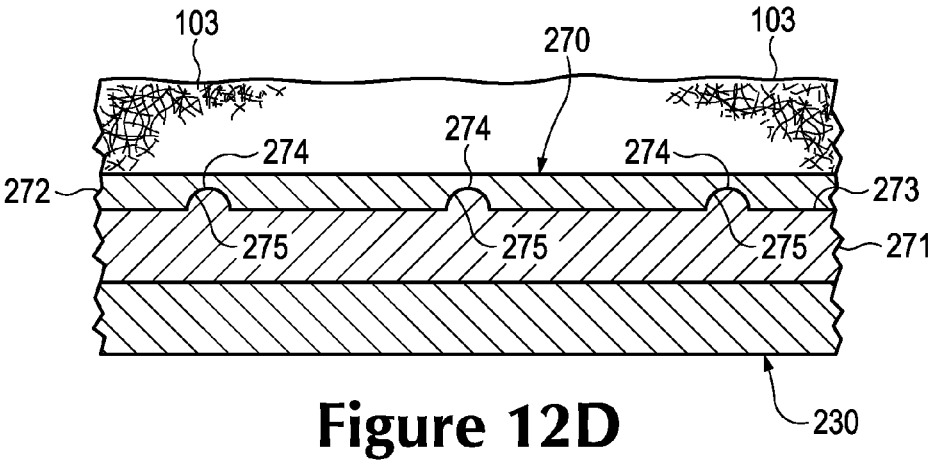
Figure 11E:
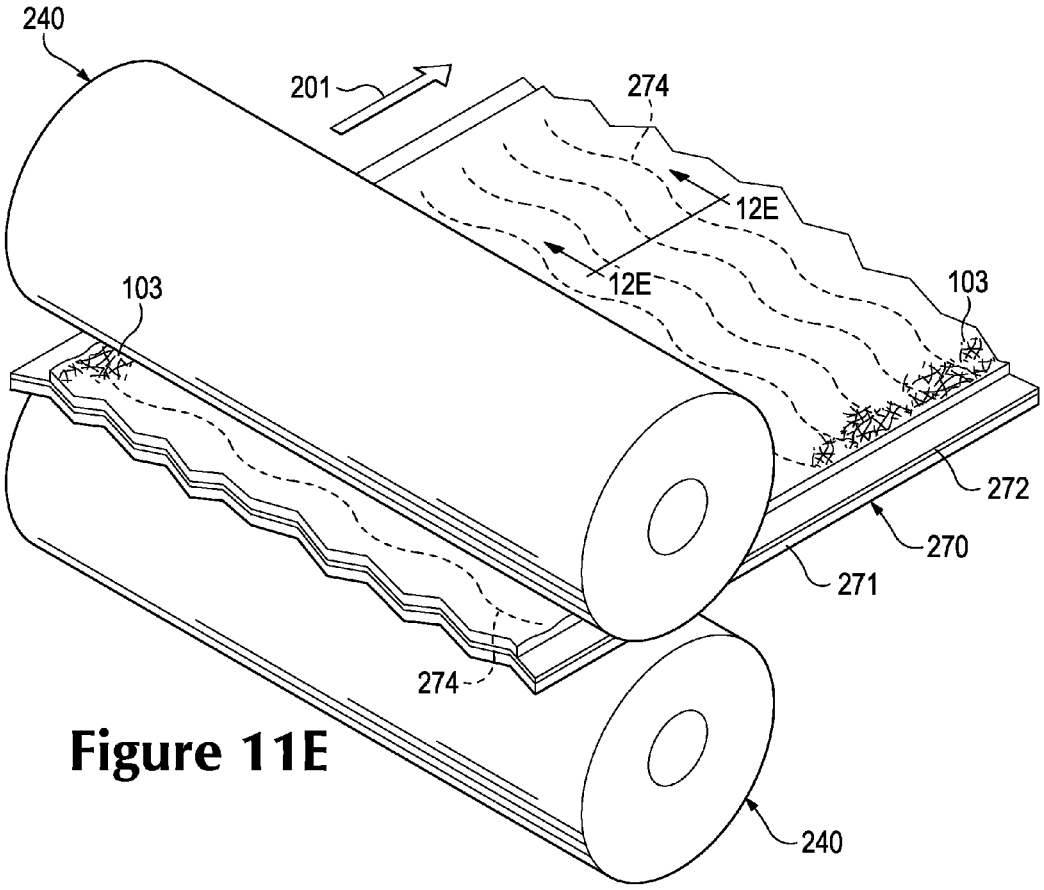
Figure 12E:
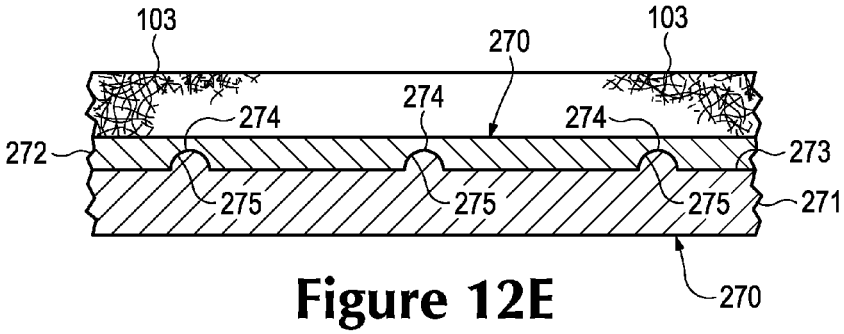

After passing adjacent to filament extruder 210, a complete layer of filaments 103 is collected upon skin layer 272, as depicted in FIGS. 11D and 12D. Although the layer of filaments 103 has a relatively uniform thickness, some surface irregularities may be present due to the random manner in which filaments 103 are deposited upon skin layer 272. As this stage, layered element 270 and the layer of filaments 103 pass between rollers 240, as depicted in FIGS. 11E and 12E. Rollers 240 compress layered element 270 and the layer of filaments 103 to (a) ensure that filaments 103 bond with skin layer 272 (b) smooth surface irregularities that are present in the layer of filaments 103. Additionally, rollers 240 may be heated to raise the temperature of the layer of filaments 103 during compression.

Figure 11F:
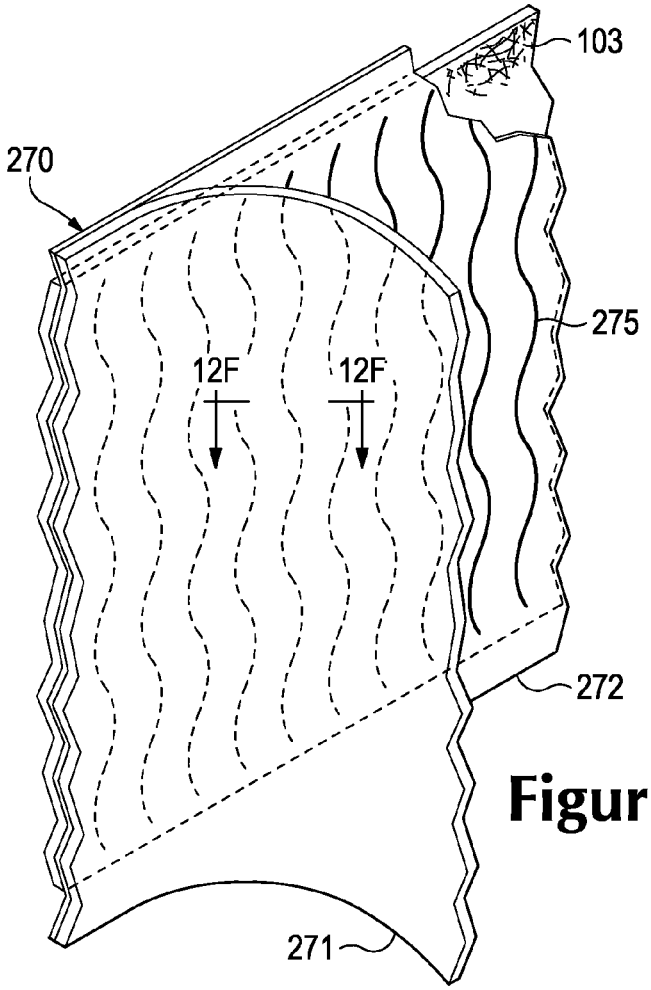
Figure 12F:
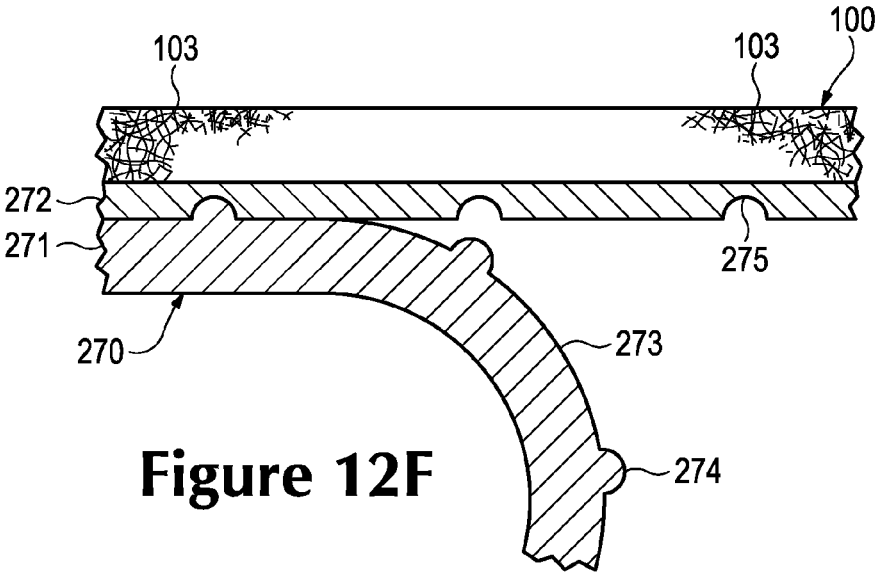

At this point in the manufacturing process for textured element 100, texture layer 271 is separated from skin layer 272, as depicted in FIGS. 11F and 12F. More particularly, the combination of the layer of filaments 103 and skin layer 272 is separated from texture layer 271. Various post-processing may now be performed to refine the properties of the layer of filaments 103 and skin layer 272, thereby completing the manufacturing process and forming a structure similar to the variation of textured element 100 in FIG. 4F.

The invention is disclosed above and in the accompanying figures with reference to a variety of configurations. The purpose served by the disclosure, however, is to provide an example of the various features and concepts related to the invention, not to limit the scope of the invention. One skilled in the relevant art will recognize that numerous variations and modifications may be made to the configurations described above without departing from the scope of the present invention, as defined by the appended claims.

The invention claimed is:

1. A method of manufacturing a textured element comprising:

collecting a plurality of filaments upon a textured surface to form a non-woven textile and to imprint a texture of the textured surface onto the non-woven textile, wherein the textured surface is one of (a) a release paper and (b) a release paper coupled to a moving conveyor; and separating the non-woven textile from the textured surface, wherein the non-woven textile retains the texture of the textured surface after it is separated from the textured surface.

2. The method recited in claim 1, further including a step of extruding a thermoplastic polymer material to form the filaments.

3. The method recited in claim 1, further including a step of compressing the non-woven textile against the textured surface.

4. The method recited in claim 1, further including a step of drawing air through the textured surface.

5. The method recited in claim 1, further including a step of selecting the textured surface to have at least one of (a) a plurality of protrusions with a height in a range of 0.1 to 3.0 millimeters and (b) a plurality of indentations with a depth in a range of 0.1 to 3.0 millimeters.

6. A method of manufacturing a textured element comprising:

depositing a plurality of filaments upon a moving and endless loop of textured release paper to form a non-woven textile; and separating the non-woven textile from the textured release paper.

7. The method recited in claim 6, further including a step of forming the filaments from a thermoplastic polymer material.

8. The method recited in claim 6, further including a step of compressing the non-woven textile against the textured release paper.

9. The method recited in claim 6, further including a step of drawing air through the textured release paper.

10. A method of manufacturing a textured element comprising:

extruding a plurality of substantially separate filaments that include a thermoplastic polymer material; and depositing the filaments upon a moving surface to (a) join the filaments to form a non-woven textile and (b) to imprint a texture of the moving surface onto the non-woven textile, wherein the moving surface is one of (a) a release paper and (b) a release paper coupled to a conveyor.

11. The method recited in claim 10, further including a step of compressing the non-woven textile against the moving surface.

12. The method recited in claim 10, further including a step of drawing air through the moving surface.

13. A method of manufacturing a textured element comprising:

positioning an extruder proximal to a release paper having (a) a width of at least 30 centimeters in a direction that is perpendicular to a direction of movement of the moving surface and (b) a texture that extends across at least a portion of the width and includes a plurality of protrusions with a height in a range of 0.1 to 3.0 millimeters;

extruding a plurality of separate and unjoined filaments from the extruder, the filaments having a thickness in a range of 1 to 100 microns, and the filaments including a thermoplastic polymer material;

depositing the filaments upon the release paper to form a non-woven textile, the protrusions extending into a surface of the non-woven textile to imprint the texture of the moving surface onto the non-woven textile;

compressing the non-woven textile against the release paper; and separating the non-woven textile from the moving surface.

14. The method recited in claim 13, further including a step of drawing air through the release paper.

15. The method recited in claim 13, wherein the release paper is a moving release paper.

16. The method recited in claim 13, wherein the release paper is coupled to a conveyor.

* * * * *